US009793074B2

(12) United States Patent
Yamanaka

(10) Patent No.: US 9,793,074 B2
(45) Date of Patent: Oct. 17, 2017

(54) MULTI-DIRECTIONAL OPERATION SWITCH

(71) Applicant: Hosiden Corporation, Yao-shi (JP)

(72) Inventor: Satoshi Yamanaka, Yao (JP)

(73) Assignee: Hosiden Corporation, Osaka (JP)

( * ) Notice: Subject to any disclaimer, the term of this patent is extended or adjusted under 35 U.S.C. 154(b) by 14 days.

(21) Appl. No.: 14/832,114

(22) Filed: Aug. 21, 2015

(65) Prior Publication Data

US 2016/0055992 A1 Feb. 25, 2016

(30) Foreign Application Priority Data

Aug. 25, 2014 (JP) ..... 2014-170571

(51) Int. Cl.

| | |
|---|---|
| ***H01H 19/00*** | (2006.01) |
| ***H01H 19/14*** | (2006.01) |
| ***H01H 19/02*** | (2006.01) |
| ***H01H 19/04*** | (2006.01) |
| ***H01H 25/00*** | (2006.01) |

(52) U.S. Cl.

CPC ..... *H01H 19/14* (2013.01); *H01H 19/025* (2013.01); *H01H 19/04* (2013.01); *H01H 25/006* (2013.01); *H01H 2205/002* (2013.01); *H01H 2300/012* (2013.01)

(58) Field of Classification Search

CPC ..... H01H 2025/043–25/06; G05G 9/04737–2009/04744

USPC ..... 200/292, 6 A, 5 R, 18

See application file for complete search history.

(56) References Cited

U.S. PATENT DOCUMENTS

| | | | | |
|---|---|---|---|---|
| 4,330,694 | A | 5/1982 | Ogawa | |
| 5,047,596 | A * | 9/1991 | Ebishi | G05G 9/04792 200/315 |
| 6,812,415 | B1 * | 11/2004 | Priesemuth | B60R 1/07 200/5 R |
| 7,214,894 | B1 | 5/2007 | Kakuno et al. | |
| 2005/0040018 | A1 | 2/2005 | Gotoh | |
| 2013/0112532 | A1 | 5/2013 | Suzuki | |
| 2015/0318128 | A1 * | 11/2015 | Noh | H01H 25/04 200/4 |

FOREIGN PATENT DOCUMENTS

| | | |
|---|---|---|
| EP | 1764814 A1 | 3/2007 |
| JP | 201398130 A | 5/2013 |

* cited by examiner

*Primary Examiner* — Vanessa Girardi
(74) *Attorney, Agent, or Firm* — The Webb Law Firm

(57) ABSTRACT

A multi-directional operation switch that can be miniaturized is provided. The multi-directional operation switch includes an operation rod that is rotatable about an operation rod axis, and is also tiltable. The operation rod has an inner end portion inserted in a hole in a circuit substrate, and a slider, which operates in conjunction with an operation of the operation rod, is provided on the inner end portion. The slider has a movable contact. The circuit substrate has a plurality of fixed contacts that are brought into contact with, and are electrically connected to, the movable contact when the slider rotates or slides.

12 Claims, 18 Drawing Sheets

MULTI-DIRECTIONAL OPERATION SWITCH

CROSS REFERENCE TO RELATED APPLICATION

This application claims priority to Japanese Patent Application No. 2014-170571 filed Aug. 25, 2014, the disclosure of which is hereby incorporated in its entirety by reference.

TECHNICAL FIELD

This disclosure relates to a multi-directional operation switch that is configured to be able to detect a rotational operation with an operation rod and a tilting operation with the operation rod.

RELATED ART

As a multi-directional operation switch that is configured as described above, JP 2013-98130A discloses technology by which: an operation rod is disposed in the state of being inserted in a through-hole formed in a circuit substrate; a rotary holder and a wafer are disposed on the upper surface side of the circuit substrate; and a rotary slider is disposed on the lower surface side of the circuit substrate.

JP 2013-98130A employs a configuration for rotationally moving the rotary holder in conjunction with a rotational operation with the operation rod, and detecting the rotation of this rotary holder at contact points disposed between the rotary holder and the wafer. JP 2013-98130A also employs a configuration for sliding the rotary slider along the circuit substrate in conjunction with a tilting operation with the operation rod, and detecting this sliding movement at contact points disposed between the rotary slider and the substrate.

SUMMARY

As in the configuration disclosed in JP 2013-98130A, in a configuration in which a constituent member that rotates in conjunction with a rotational operation with the operation rod is disposed on the side of one surface of the circuit substrate, and a constituent member that slides in conjunction with a tilting operation with the operation rod is disposed on the side of the other surface of the circuit substrate, two constituent members that operate in conjunction with an operation with the operation rod are required, which leads to an increase in size of the switch.

Also, in the configuration including a constituent member that rotates in conjunction with a rotational operation with the operation rod and a constituent member that slides in conjunction with a tilting operation with the operation rod, a high degree of accuracy is required in terms of the positional relationship between movable contact points provided on the two constituent members and fixed contact points provided on the substrate and so on, and accordingly there is the possibility that a lot of time and effort is required for assembling and adjustment.

In particular, in the case of a configuration in which the operation rod has a knob at one end for example, when consideration is given to a configuration for illuminating the knob from the inside in order to allow the user to know the position of the knob at night, a configuration as disclosed in JP 2013-98130A, in which a constituent member is provided on the surface of the circuit substrate where the knob of the operation rod is disposed, does not have space for disposing a light source such as an LED, and there is room for improvement.

An embodiment of this disclosure provides a multi-directional operation switch that can be miniaturized.

One embodiment of a multi-directional operation switch according to this disclosure includes: a circuit substrate having a hole formed therein; a casing that houses the circuit substrate therein; an operation rod having an outer end portion exposed to the outside of the casing, an inner end portion inserted in the hole in the circuit substrate, and a middle portion, and configured to be tiltable relative to the casing, with the middle portion serving as a pivot, and rotatable about an operation rod axis extending along a longitudinal direction of the operation rod; an orientation maintaining mechanism that maintains an orientation of the operation rod to be a neutral orientation in which the operation rod is perpendicular to the circuit substrate; a slider disposed on the side of a back surface of the circuit substrate, which is the opposite side to the outer end portion of the operation rod, and configured to rotate along the back surface of the circuit substrate in conjunction with a rotational operation with the operation rod, and to slide along the back surface in conjunction with a tilting operation with the operation rod; and an operation detector that detects a rotation position and a slide position of the slider. The operation detector has a plurality of fixed contacts formed on the back surface of the circuit substrate, and a movable contact that is supported by the slider so as to be brought into contact with, and electrically connected to, the plurality of fixed contacts when the slider rotates or slides With this configuration, when the operation rod is in the state of not being operated, the operation rod can be maintained in the neutral orientation by the orientation maintaining mechanism. Also, due to the plurality of fixed contacts formed on the back surface of the circuit substrate and the movable contact of the slider, it is possible to detect a tilting operation with the operation rod, with the middle portion of the operation rod serving as a pivot, and a rotational operation with the operation rod about the operation rod axis. This configuration makes it unnecessary to form fixed contacts for detecting the operation state of the operation rod on both sides of the circuit substrate, and makes it possible to eliminate, or reduce the number of, the constituent members provided on the side of the front surface of the circuit substrate.

Thus, a multi-directional operation switch that can be miniaturized is configured.

In one embodiment of a multi-directional operation switch according to this disclosure, the operation rod is configured to allow a rotational operation about the operation rod axis only when the operation rod is in the neutral orientation, and the operation rod is configured to be able to be operated to a right position and a left position by being rotated by a rotational operation to a rightward direction and a leftward direction with reference to a neutral position, respectively, and to allow a tilting operation only when the operation rod is in the right position or the left position, and the plurality of fixed contacts includes: a first fixed contact that overlaps the movable contact of the slider when the operation rod is in the neutral orientation and has been switched to the right position or the left position; and a pair of second fixed contacts that are arranged separately from each other along a sliding direction of the slider, with the first fixed contact therebetween, such that the pair of second fixed contacts are brought into contact with, and are electrically connected to, the movable contact when the slider slides along with a tilting operation with the operation rod.

With this configuration, the operation rod allows a rotational operation only when the operation rod is in the neutral orientation, and allows a tilting operation only when the operation rod is set to the right position or the left position by a rotational operation with the operation rod. Furthermore, regardless of whether the operation rod has been operated to the right position or the left position, the movable contact can be brought into contact with, and electrically connected to, the second fixed contacts, or both the first fixed contact and the second fixed contacts simultaneously, by a tilting operation with the operation rod. Thus, a tilting operation with the operation rod can be detected.

In one embodiment of a multi-directional operation switch according to this disclosure, the movable contact has a pair of contact points, and when the operation rod is in the neutral position, the pair of contact points are in contact with, and are electrically connected to, the pair of second fixed contacts.

With this configuration, when the operation rod is in the neutral position, each of the pair of contact points of the movable contact is brought into contact with, and is electrically connected to, the second fixed contacts. Thus, the operation rod in the neutral position can be detected.

One embodiment of a multi-directional operation switch according to this disclosure includes a rotor that is disposed within the casing, on the side of a front surface of the circuit substrate, and rotates with the operation rod in a unified manner; and a cam member that protrudes outward from the rotor due to a biasing force applied in a direction that is perpendicular to the operation rod axis. An inner surface of the casing has: a plurality of depression areas into which the cam member fits every time the operation rod reaches a predetermined rotation position due to a rotational operation with the operation rod, thereby maintaining the rotation position of the operation rod; and a guiding surface that changes an operation load of a rotational operation, acting within an area continuous with the plurality of depression areas.

With this configuration, when the operation rod is rotated, the cam member stabilizes the rotation position of the operation rod by fitting into a depression area, and the resistance against a rotational operation can be varied, which is reflected in the operating sensation. As a result, the operation rod can be maintained in a desired rotation position, and the user can know that the operation rod is in the rotation position based on the operating sensation.

One embodiment of a multi-directional operation switch according to this disclosure includes: a rotor that is disposed within the casing, on the side of a front surface of the circuit substrate, and rotates with the operation rod in a unified manner; a knob that is disposed outside the casing, on the side of the outer end portion of the operation rod, and includes light-transmissive material; and a light-emitter that is disposed on the side of the front surface of the circuit substrate and emits light when supplied with power. At least one of the operation rod and the rotor includes light-transmissive material.

With this configuration, light rays from the light-emitter disposed on the side of the front surface of the circuit substrate can be caused to pass through the inside of at least one of the operation rod and the rotor and travel to the knob, so that the knob can be illuminated from the inside. In other words, it is unnecessary to provide a constituent member for detecting the operation state of the operation rod on the side of the front surface of the circuit substrate, and it is possible to improve the visibility of the knob at night for example, by allowing light rays from the light-emitter disposed on the side of the front surface of the circuit substrate to reach the knob without being attenuated.

DESCRIPTION OF EMBODIMENTS

The following describes an embodiment of this disclosure with reference to the drawings.

[Overall Structure]

As shown in FIG. 1 to FIG. 4, a multi-directional operation switch is configured to include: an operation rod 20 having an operation rod axis Q that coincides with a casing axis Z of a casing 10; a knob 26 made of resin and provided at an outer end of the operation rod 20; and an operation detector A that detects a rotational operation with the knob 26 (the operation rod 20) about the casing axis Z and a tilting operation with the knob 26 (operation rod 20).

Figure 2:
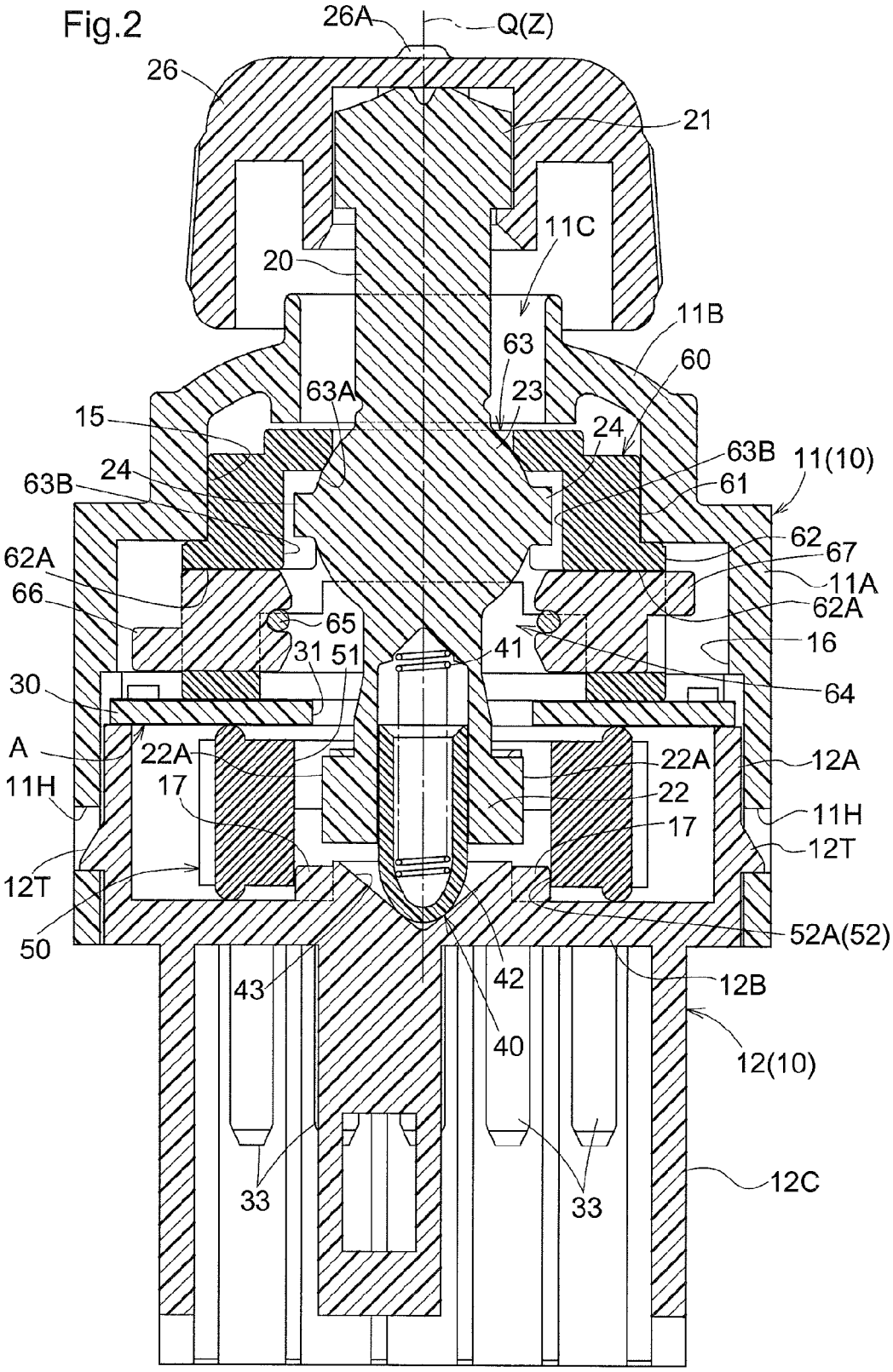
FIG. 2 is a cross-sectional lateral view of the multi-directional operation switch.
Figure 11:
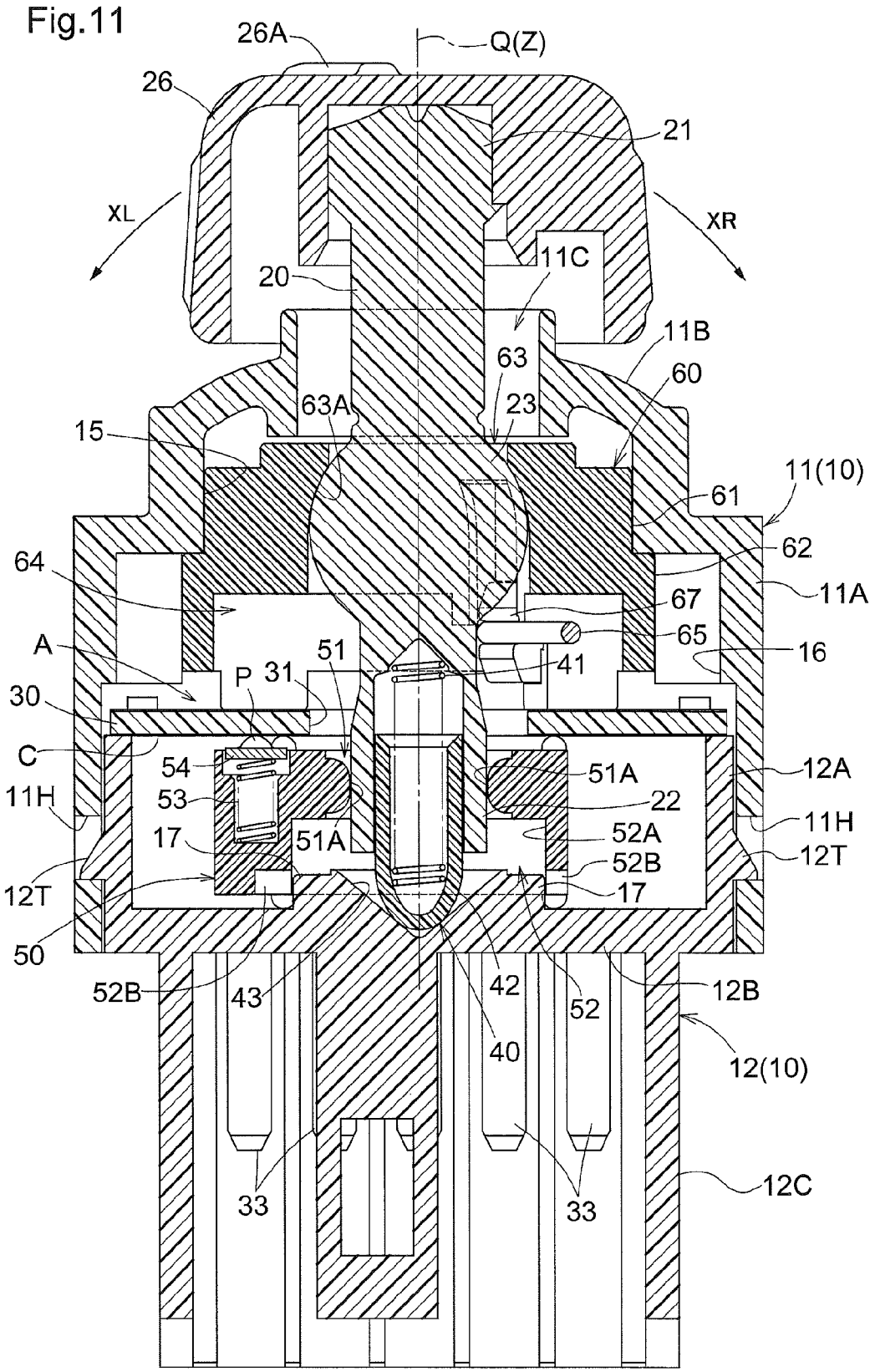
FIG. 11 is a cross-sectional lateral view of the multi-directional operation switch in a state of not being operated.

This multi-directional operation switch is used for controlling power door mirrors of a vehicle such as a passenger car, from the driver seat or its vicinity. As shown in FIG. 2 and FIG. 11, the switch, when used, is typically orientated such that the casing axis Z coincides with the vertical direction. Although the orientation of this multi-directional operation switch when used is not particularly limited, the following describes the positional relationship between the constituent elements based on the vertical position.

In this multi-directional operation switch, the casing 10 includes an upper casing 11 made of resin and a lower casing 12 made of resin, and a circuit substrate 30 having a hole 31 in its central portion is housed within the casing 10. The operation rod 20 is disposed such that its outer end portion is exposed to the outside of the casing 10 and its inner end portion is inserted in the hole 31. The operation rod 20 is pivoted at a spherical middle portion 23, which is a middle portion of the operation rod 20, so as to be tiltable relative to the casing 10, and also rotatable about the operation rod axis Q. Also, the knob 26 is fixed to a protrusion of the outer end portion. The knob 26 is configured such that at least an area around an indicator 26A can be illuminated by light from a light source inside the casing 10. Although the knob 26 may be entirely transparent or translucent, it may also be manufactured by two-color molding (double molding), using light-transmissive resin in the indicator 26A, a lettered part on the surface of the knob 26, etc., and non-light transmissive resin in other parts.

The operation rod 20 is made from transparent or translucent resin so as to allow light rays from the light source to pass through it, and an orientation maintaining mechanism 40 is provided at the edge of the inner end portion of the operation rod 20 and maintains the operation rod 20 in its neutral orientation, in which the operation rod 20 is orientated to be perpendicular to the circuit substrate 30. A slider 50 made of resin is disposed on the side of the back surface of the circuit substrate 30, which is the surface that faces the inner end portion of the operation rod 20 (the lower surface in FIG. 2 and FIG. 3; the surface on the opposite side to the outer end portion of the operation rod 20). The slider 50 rotates along the back surface of the circuit substrate 30 along with a rotational operation with the operation rod 20, and slides along the back surface of the circuit substrate 30 in conjunction with a tilting operation with the operation rod 20.

As shown in FIG. 3 to FIG. 6, the operation detector A includes: a plurality of fixed contacts C formed on the back surface of the circuit substrate 30; and a pair of movable contacts 54 that are brought into contact with, and are electrically connected to, the fixed contacts C when the slider 50 operates. Note that insulation coatings 30A are respectively formed on the front surface and the back surface of the circuit substrate 30, and the fixed contacts C are exposed from an opening formed in the insulation coating 30A on the side of the back surface.

On the operation rod 20 and on the side of the front surface of the circuit substrate 30 (the upper surface in FIG. 2 and FIG. 3), there is provided a rotor 60 that rotates with the operation rod 20 in a unified manner, and that is made of transparent or translucent resin so as to allow light rays to pass through it. As shown in FIG. 3, FIG. 4, and FIG. 7 to FIG. 10, the rotor 60 has a torsion spring 65 that applies a biasing force in the direction that is perpendicular to the casing axis Z, and a first cam member 66 and a second cam member 67 are provided at the respective tips of the torsion spring 65 and protrude outward along the respective radial directions of the rotor 60 due to the biasing force. The first cam member 66 and the second cam member 67 are disposed in a virtual straight line that is perpendicular to the casing axis Z, and a cam surface 16, with which the first cam member 66 and the second cam member 67 are brought into contact, is formed on the inner surface of the upper casing 11.

This multi-directional operation switch is configured to be able to be operated to a right position R, a left position L, a retraction position H, or a neutral position N by a rotational operation with the knob 26 about the operation rod axis Q. In addition, the indicator 26A is formed on the upper surface of the knob 26 in order to allow the user to visually know the operational position of the knob 26.

Figure 12:
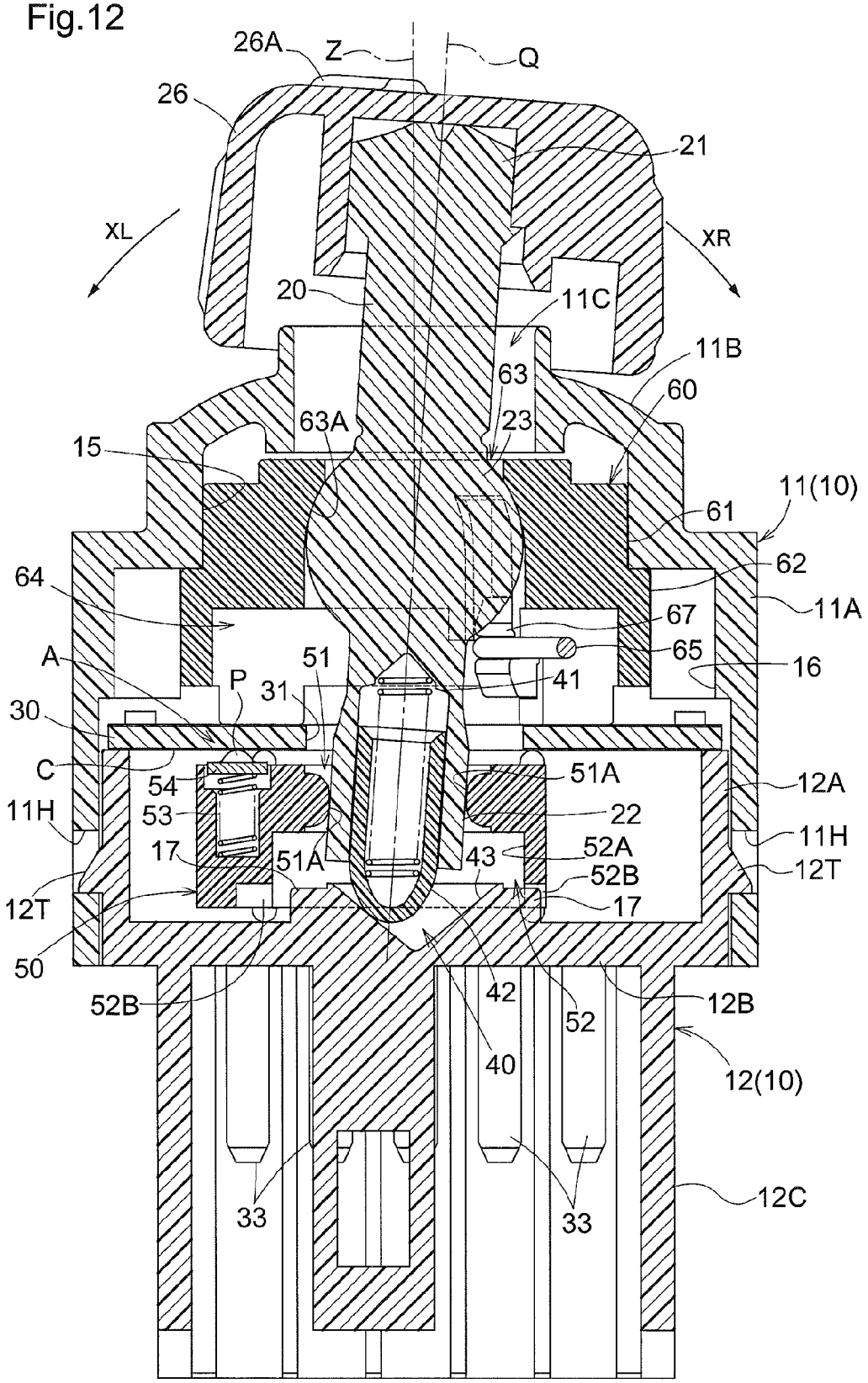
FIG. 12 is a cross-sectional lateral view of the multi-directional operation switch in a tilted state.

It should be particularly noted that the operation rod 20 is configured to allow a rotational operation about the operation rod axis Q only when the operation rod 20 is in the neutral orientation as shown in FIG. 2 and FIG. 11, and that the operation rod 20 is configured to be able to be set to the right position R and the left position L respectively by a rightward rotational operation and a leftward rotational operation with reference the neutral positon N. Furthermore, it is only when the operation rod 20 is set to the right position R or the left position L that the operation rod 20 can be operated to the forward, backward, leftward, or rightward direction by a tilting operation as shown in FIG. 12. Note that this multi-directional operation switch is configured such that the knob 26 can be rotated by more than 360 degrees both rightward and leftward.

Figure 1:
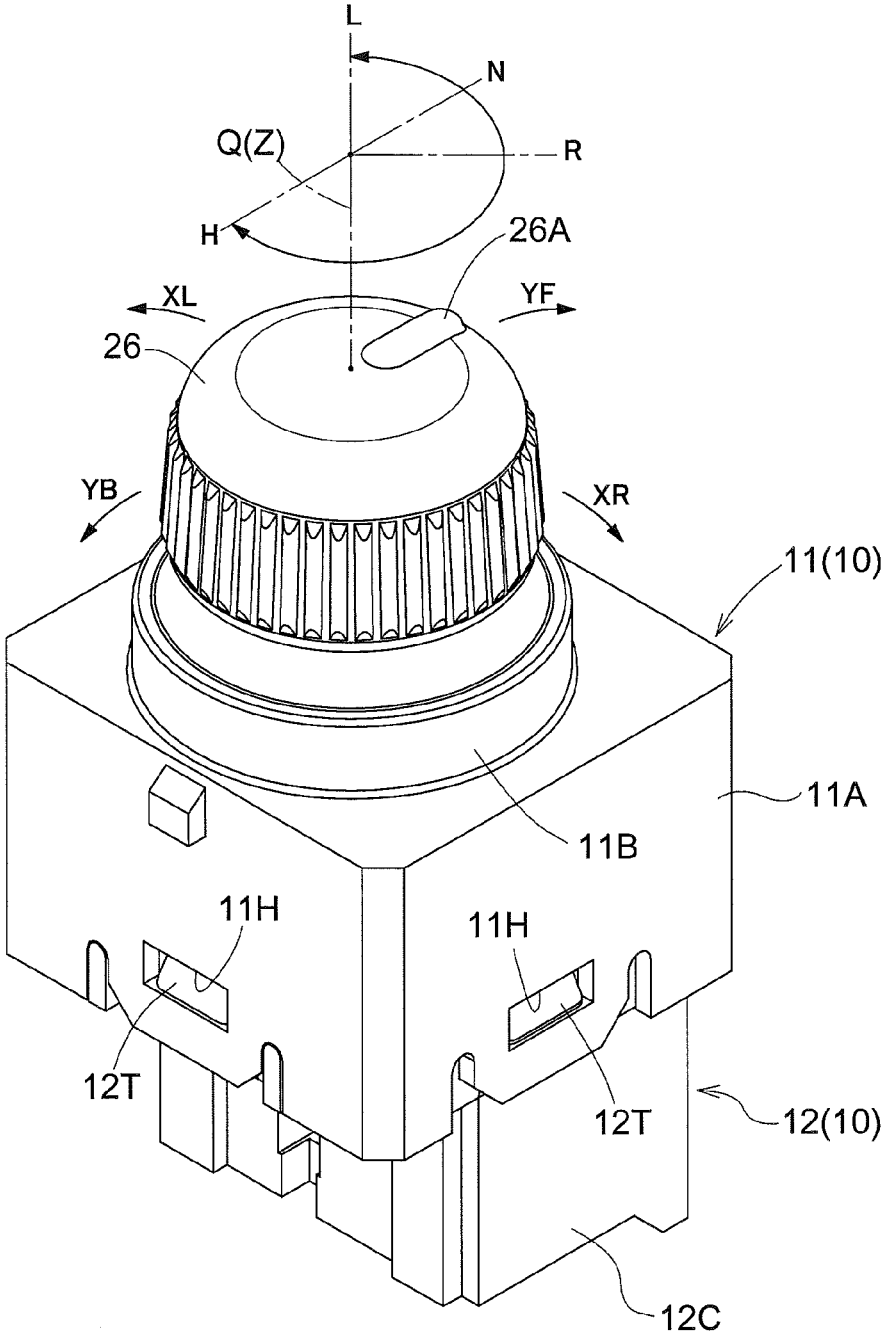
FIG. 1 is a perspective view of a multi-directional operation switch.

As shown in FIG. 1, the operation rod 20 is configured to be tiltable by a human operation in the leftward/rightward direction indicated by "XL"/"XR" and in the forward/backward direction indicated by "YF"/"YB". The leftward/rightward direction XL/XR and the forward/backward direction YF/YB are set to be perpendicular to each other. Thus the operation rod 20 can be operated in four directions.

Figure 5:
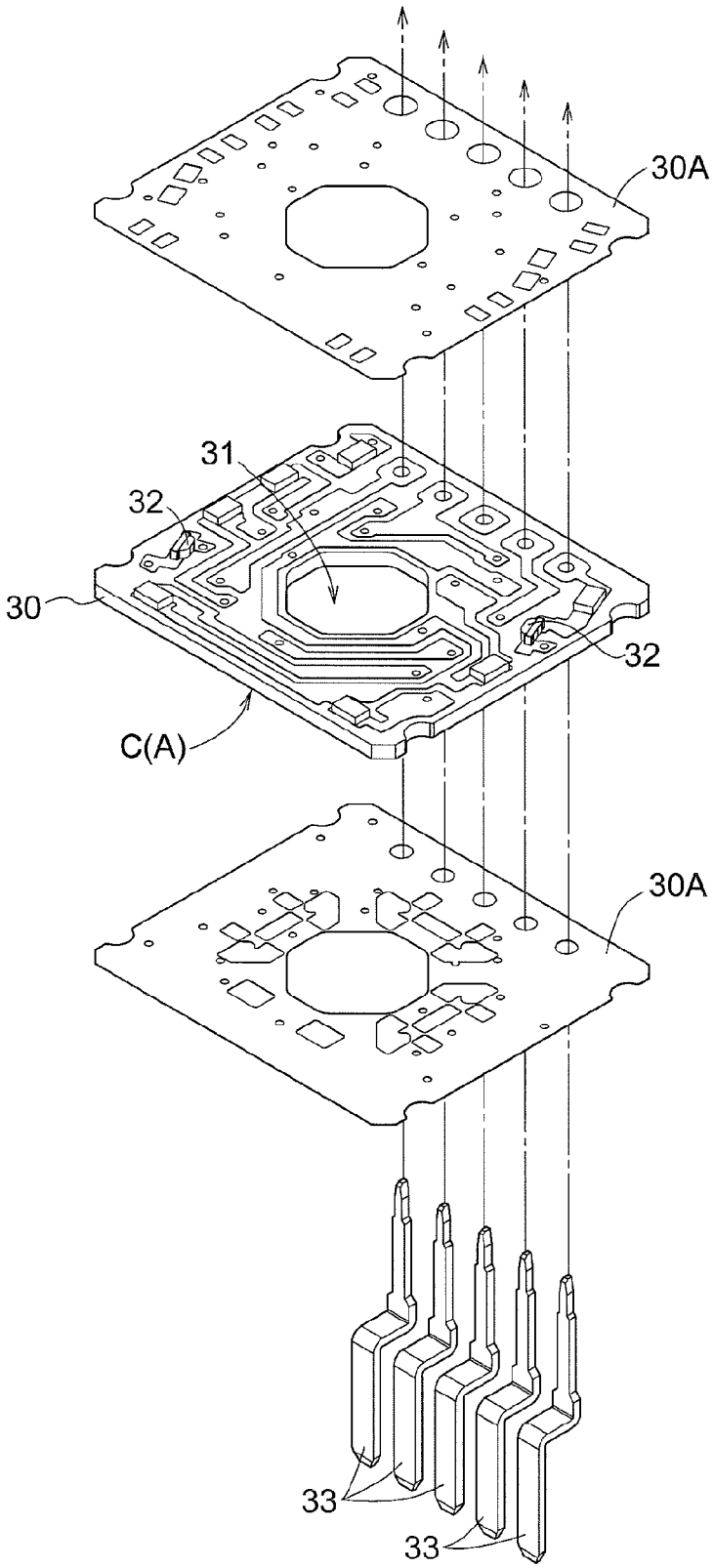
FIG. 5 is an explode perspective view of a circuit substrate and leads.

As shown in FIG. 5, the circuit substrate 30 is provided with a printed wiring that is electrically connected to the above-described fixed contacts C, and a plurality of leads 33, which are electrically connected to the printed wiring, are disposed on the back surface so as to protrude downward. Signals detected from this multi-directional operation switch are output from the plurality of leads 33 to a control device such as an ECU for controlling the power door mirrors.

Note that the power door mirrors have a known configuration including a retraction motor for retracting and extending the mirror body, a vertical angle motor for adjusting the angle of the mirror in the vertical direction, and a horizontal angle motor for adjusting the angle of the mirror in the horizontal direction.

The control device achieves door mirror angle adjustment by controlling the corresponding motor when the operation rod 20 is tilted in the leftward/rightward direction or the forward/backward direction while the knob 26 is in the right position R or the left position L. Furthermore, when the knob 26 is operated to the retraction position H, the control device sets the left and right door mirrors to be in their retracted positions. In particular, when the fog lights or head lights of the vehicle are in the turned-on state, light emitting diodes 32 provided on the circuit substrate 30, which serve as light-emitters, are supplied with power and emit light.

[Casing, Operation Rod, Orientation Maintaining Mechanism]

Figure 3:
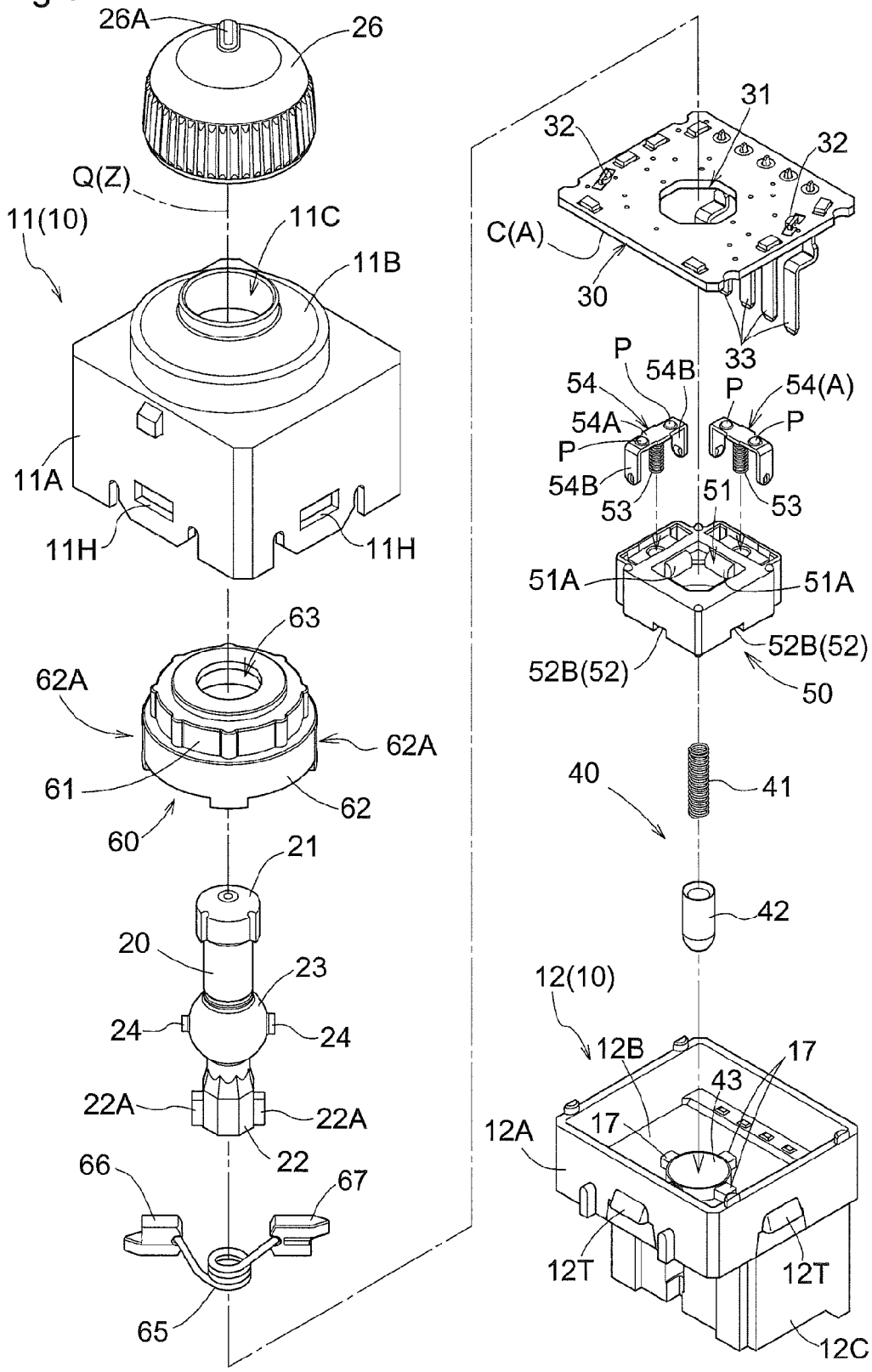
FIG. 3 is an exploded perspective view from above of the multi-directional operation switch.
Figure 4:
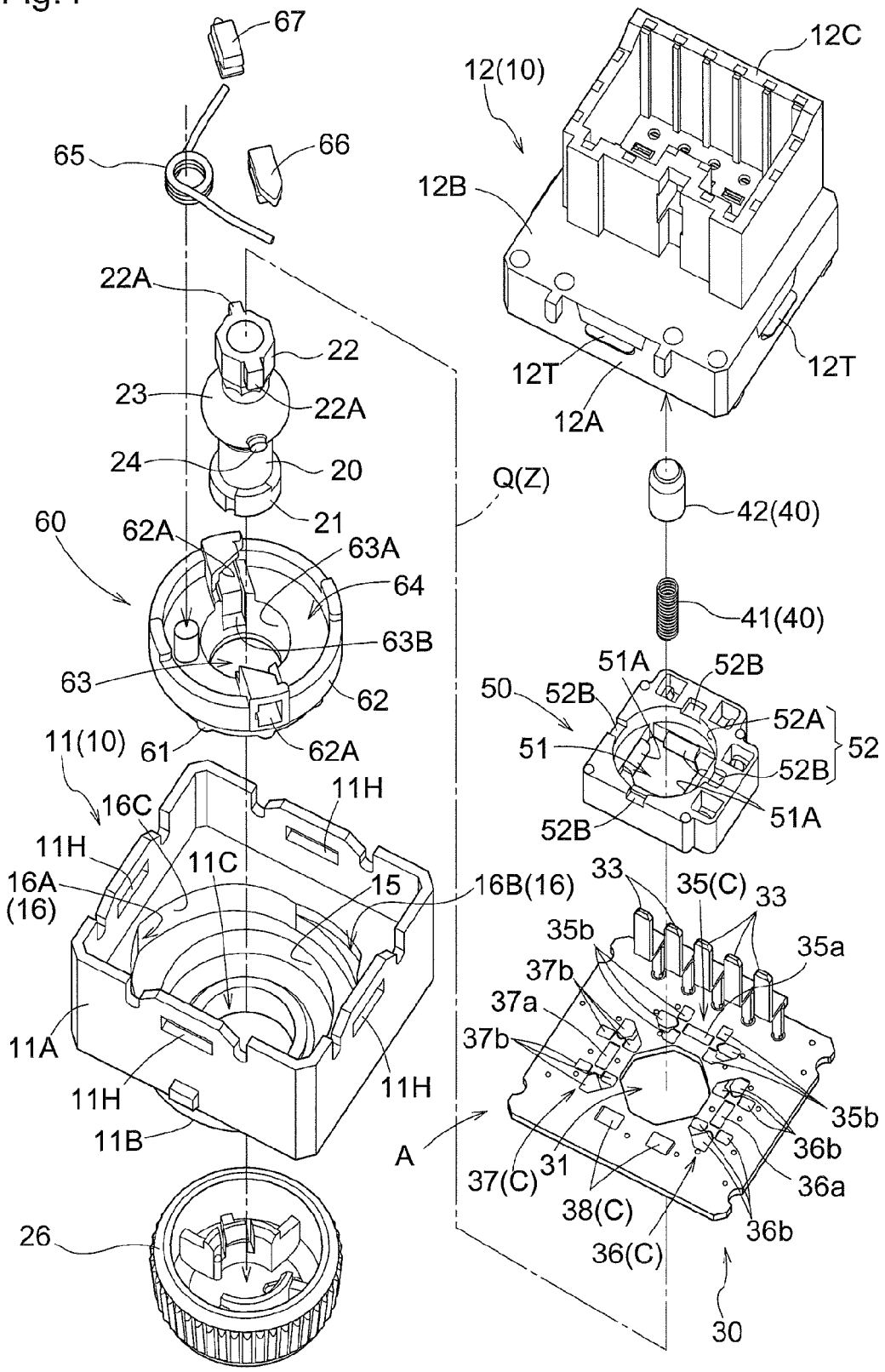
FIG. 4 is an exploded perspective view from below of the multi-directional operation switch.

As shown in FIG. 2 to FIG. 4, the upper casing 11 is made up of an outer casing part 11A, which has a square shape when seen in the direction along the casing axis Z; and a dome-like part 11B, which is disposed above the outer casing part 11A and has a semi-spherical dome-like shape. The outer casing part 11A and the dome-like part 11B are formed so as to be integrated into one piece, and an opening 11C is formed in the upper edge of the dome-like part 11B, through which the operation rod 20 is inserted.

The inner surface of the upper casing 11 includes a rotation supporting surface 15 and the cam surface 16. The rotation supporting surface 15 is a circumferential inner surface extending along a circle centered at the casing axis Z and rotatably supporting the rotor 60. The cam surface 16 is the surface with which the first cam member 66 and the second cam member 67 are brought into contact as described above.

The lower casing 12 is made up of an inner casing part 12A, which is disposed at the upper positon, and which has a square shape and fits into the outer casing part 11A of the upper casing 11; a bottom wall part 12B, which is formed at the bottom of the inner casing part 12A; and a lead housing part 12C, which is disposed below the bottom wall part 12B, and in which the plurality of leads 33 are housed. The inner casing part 12A, the bottom wall part 12B, and the lead housing part 12C are formed so as to be integrated into one piece.

Engagement holes 11H are formed in the outer wall part of the outer casing part 11A of the upper casing 11, and engagement protrusions 12T, which can engage with the engagement holes 11H, are formed on the outer surface of the inner casing part 12A of the lower casing 12 so as to protrude from the surface. Therefore, the upper casing 11 and the lower casing 12 are maintained in the connected state by engaging the engagement protrusions 12T with the engagement holes 11H.

The operation rod 20 has a rod-like shape as a whole, and includes: a large-diameter part 21 at the outer edge, to which the knob 26 is connected; and an engagement part 22 at the inner edge, which has a cross section in a regular octagon shape. On the outer circumferential surface of the engagement part 22, a pair of actuating pieces 22A, which protrude outward, are formed so as be integrated into one piece. Also, the spherical middle portion 23, which is the middle portion of the operation rod 20 and has a spherical shape, is formed so as to be integrated into one piece, and a pair of engaging rod parts 24, which protrude in the direction that is perpendicular to the operation rod axis Q, are formed on the outer circumferential surface of the spherical middle portion 23. The inner end portion of the operation rod 20 is formed as a hollow part that is coaxial with the casing axis Z, and a spring 41, which is a compression coil spring, is housed within the hollow part, and a protruding member 42, which is biased by the spring 41 so as to protrude, is also housed within the hollow part.

In a central portion of the bottom wall part 12B of the lower casing 12, a neutral depression part 43, which has a recess having a cone-like shape, is formed. The protruding end portion of the protruding member 42 is tapered, and has a smooth surface. The spring 41, the protruding member 42, and the neutral depression part 43 constitute the orientation maintaining mechanism 40. The orientation maintaining mechanism 40 is configured such that when the operation rod 20 is in the state of not being operated, the protruding member 42 fits into the central portion of the neutral depression part 43 and becomes stable due to the biasing force of the spring 41, and consequently, the operation rod axis Q of the operation rod 20 becomes perpendicular to the circuit substrate 30, and the operation rod 20 takes the neutral orientation, in which the operation rod axis Q becomes coaxial with the casing axis Z.

As shown in FIG. 3 and FIG. 7 to FIG. 10, regulating protrusions 17 are respectively formed at four positions that are adjacent to the outer circumferential surface of the neutral depression part 43 and that correspond to the directions that intersect at right angles at the center point of the neutral depression part 43.

[Rotor]

The rotor 60 has a first outer circumferential surface 61 and a second outer circumferential surface 62 that has a larger diameter than the first outer circumferential surface 61, and a through-hole part 63, through which the operation rod 20 is inserted, is formed in the central portion of the rotor 60. Thus, the rotor 60 has a ring-like shape as a whole. Also, a spring housing space 64 is formed in an area that is continuous with the through-hole part 63.

Since the rotor 60 is fit into the rotation supporting surface 15 of the upper casing 11 so as to be rotatable about the casing axis Z, the first outer circumferential surface 61 has a plurality of protrusions that reduce frictional resistance during rotation. The second outer circumferential surface 62 has cam holes 62A respectively corresponding to the first cam member 66 and the second cam member 67 so that the first cam member 66 and the second cam member 67 are supported by the cam holes 62A so as to be extendable and retractable. In this configuration, the first cam member 66 is fit into one of the cam holes 62A, and the second cam member 67 is fit into the other one of the cam holes 62A, and the first cam member 66 and the second cam member 67 are biased by the torsion spring 65 housed in the spring housing space 64.

The inner surface of the through-hole part 63 has a rod supporting part 63A serving as a spherical inner surface, into which the spherical middle portion 23 of the operation rod 20 is fit, and engagement groove parts 63B, which are disposed to be continuous with the rod supporting part 63A, and into which the engaging rod parts 24 are respectively fit.

The first cam member 66 is disposed such that its cam part is adjacent to the circuit substrate 30, and the second cam member 67 is disposed such that its cam part is father from the circuit substrate 30 than the cam surface of the first cam member 66 is.

As shown in FIG. 7 to FIG. 10, the cam surface 16 includes: a pair of first depression areas 16A, into which the first cam member 66 and the second cam member 67 are respectively and simultaneously fit when the knob 26 is operated to the retraction position H or the neutral positon N; and a pair of second depression areas 16B, into one of which the first cam member 66 is fit when the knob 26 is operated to the right position R or the left position L. The cam surface 16 also includes a guiding surface 16C, which is disposed in an area that is continuous with the pair of first depression areas 16A and the pair of second depression areas 16B.

[Slider]

As shown in FIG. 3 and FIG. 4, the slider 50 has: an engagement hole part 51, which is formed in its central portion on the side of the upper surface; a guiding hole part 52, which is formed in its central portion on the side of the lower surface; and also a pair of movable contacts 54, which are biased toward the back surface of the circuit substrate 30 respectively by pressing springs 53.

The engagement hole part 51 is formed in, of the slider 50, the central portion of the surface that faces the back surface of the circuit substrate 30. The engagement hole part 51 has contact surfaces 51A, which are respectively disposed at four positions on the inner surface of the engagement hole part 51, and the engagement part 22 of the operation rod 20 is brought into contact with the contact surfaces 51A. Gaps are respectively formed at the corners of the engagement hole part 51. The pair of actuating pieces 22A formed on the engagement part 22 are respectively fit into two of the gaps, where each of the pair of actuating pieces 22A is adjacent to one pair of contact surfaces 51A.

The guiding hole part 52 is formed in, of the slider 50, the central portion of the surface that faces the bottom wall part 12B of the lower casing 12. The guiding hole part 52 has an inner circumferential surface 52A extending along a circle centered at the casing axis Z in the neutral orientation. As shown in FIG. 3 and FIG. 7 to FIG. 10, the radius of the inner circumferential surface 52A is set such that the four regulating protrusions 17 on the bottom wall part 12B of the lower casing 12 are in contact with the inner circumferential surface 52A, and four guiding grooves 52B that radially extend from the center point of the guiding hole part 52 are formed. The guiding grooves 52B are disposed so as to be respectively adjacent to the regulating protrusions 17 when the operation rod 20 is in the neutral orientation and the knob 26 is in the right position R or in the left position L.

Each of the pair of movable contacts 54 includes a main part 54A and a guiding piece 54B at both ends of the main part 54A, which are formed by bending a good conductor plate material made of copper alloy or the like, and a pair of contact points P are formed so as to protrude from the main part 54A. The movable contacts 54 are maintained to be in contact with the back surface of the circuit substrate 30 due to the biasing force applied by the pressing springs 53.

Each contact point P is formed by press working so as to constitute a piece integrated with the corresponding movable contact 54, so that the contact points P are brought into contact with, and are electrically connected to, the fixed contacts C of the circuit substrate 30. A good conductor that is abrasion-resistant may be attached to the contact points P, and the contact points P may be plated with gold in order to achieve an excellent conductive state, for example. The pair of movable contacts 54 are disposed such that their respective longitudinal directions are perpendicular to each other when seen in the direction along the casing axis Z.

With this configuration, in the situation where the engagement part 22 of the operation rod 20 is fit into the engagement hole part 51, the slider 50 rotates along the back surface of the circuit substrate 30 along with a rotational operation with the operation rod 20, and slides along the back surface of the circuit substrate 30 along with a tilting operation with the operation rod 20. In particular, since sliding is performed only in the orientation in which the regulating protrusions 17 perform relative displacement along the guiding grooves 52B, operations in four directions can be achieved. Also, when a rotational operation about the operation rod axis Q is performed in the situation where the operation rod 20 is subjected to a tilting operation, the slider 50 cannot rotate because the regulating protrusions 17 are in engagement with the guiding grooves 52B.

[Circuit Substrate]

The circuit substrate 30 is disposed so as to be sandwiched between the upper casing 11 and the lower casing 12, and the hole 31 has a size that allows displacement of the operation rod 20 along with rotation of the engagement part 22 and a tilting operation with the operation rod 20.

As shown in FIG. 3, the pair of light emitting diodes 32 are provided on the front surface of the circuit substrate 30. Also, the plurality of leads 33, each made from good conductor material such as copper alloy, are provided so as to protrude from the back surface of the circuit substrate 30. The leads 33 are electrically connected to the plurality of fixed contacts C and the light emitting diodes 32 via the printed wiring.

Figure 6:
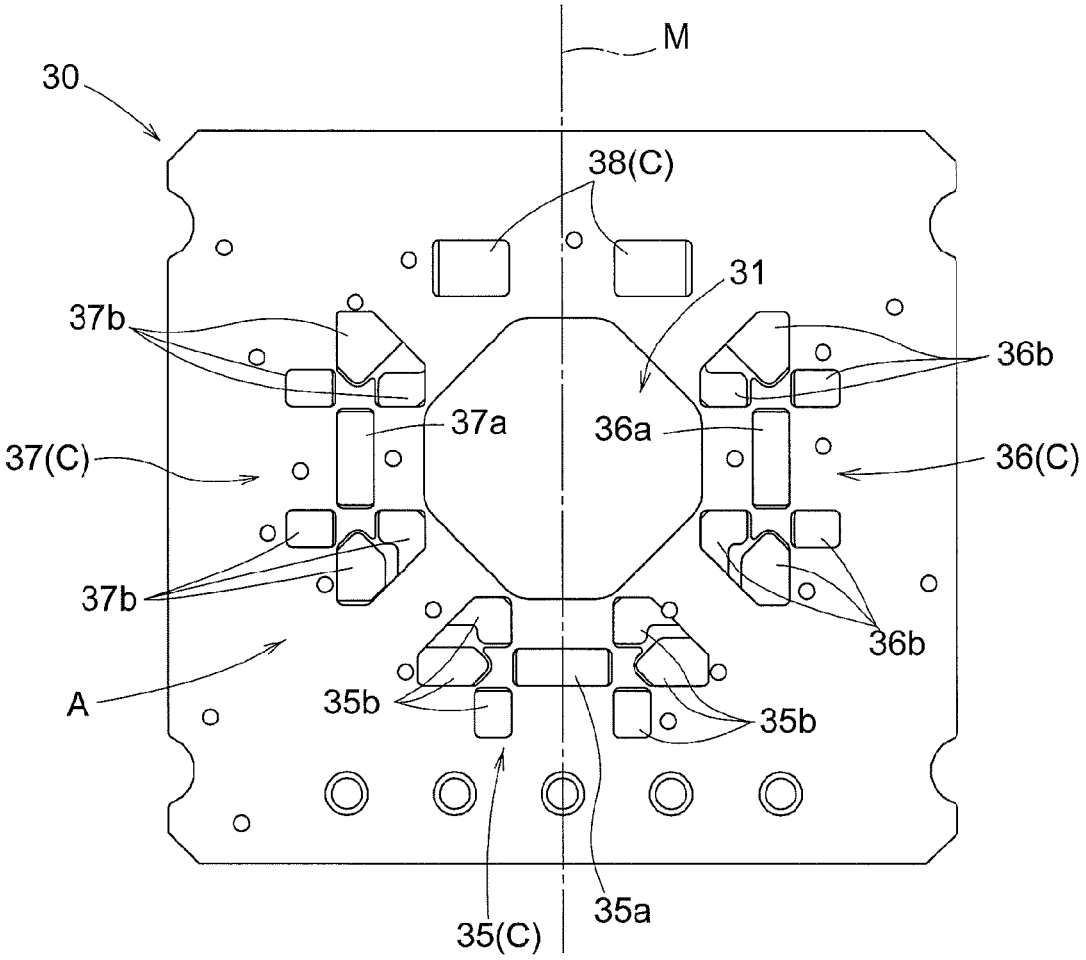
FIG. 6 is a diagram showing an arrangement of fixed contact points on the circuit substrate.

FIG. 6 is a bottom view showing the arrangement of the fixed contacts C on the circuit substrate 30. As shown in this figure, the fixed contacts C includes: a group of neutral fixed contacts 35 disposed such that a virtual line M that passes through the center point of the hole 31 passes through the group of neutral fixed contacts 35; and a group of right fixed contacts 36 and a group of left fixed contacts 37, which are disposed to be symmetrical with respect to the virtual line M. Also, a pair of retraction contacts 38 are disposed on the opposite side of the hole 31 from the group of neutral fixed contacts 35.

The group of neutral fixed contacts 35 includes: a neutral reference contact 35*a* (an example of a first fixed contact); and six neutral detection contacts 35*b* (an example of second fixed contacts) that surround the neutral reference contact 35*a*. The group of group of right fixed contacts 36 includes: a right reference contact 36*a* (an example of the first fixed contact); and six right detection contacts 36*b* (an example of the second fixed contacts) that surround the right reference contact 36*a*. The group of left fixed contacts 37 includes: a left reference contact 37*a* (an example of the first fixed contact); and six left detection contacts 37*b* (an example of the second fixed contacts) that surround the left reference contact 37*a*. The pair of retraction contacts 38 are disposed so as to be symmetrical with respect to the virtual line M.

In other words, each of the group of neutral fixed contacts 35, each of the group of right fixed contacts 36, each of the group of left fixed contacts 37, and each of the pair of retraction contacts 38 correspond to the fixed contacts C. Also, each of these contacts is electrically connected to a corresponding lead from among the plurality of leads 33. The state of electrical connection between the fixed contacts C and the movable contacts 54 is described below.

[Assembled State]

When assembling the multi-directional operation switch, the circuit substrate 30 that has been completed is used, and the pair of movable contacts 54 are attached to the slider 50 in advance. Similarly, the spring 41 and the protruding member 42 are attached to the lower edge of the operation rod 20 in advance, and the torsion spring 65, the first cam member 66, and the second cam member 67 are attached to the rotor 60 in advance.

Next, the slider 50 is disposed on the upper surface of the bottom wall part 12B of the lower casing 12, the circuit substrate 30 is disposed on the slider 50, the operation rod 20 is set such that the inner end portion of the operation rod 20 is inserted in the hole 31 in the circuit substrate 30, and the rotor 60 is disposed so as to fit onto the operation rod 20. Then, the upper casing 11 is set, and the engagement holes 11H of the upper casing 11 and the engagement protrusions 12T of the lower casing 12 are brought into engagement. Thus, these parts are integrated into one piece. After that, the knob 26 is fit onto the outer end portion of the operation rod 20 that protrudes outward from the opening 11C of the upper casing 11. Thus, the multi-directional operation switch is completed.

In this assembled state, the position of the circuit substrate 30 has been determined, and the slider 50 is disposed between the back surface of the circuit substrate 30 and the bottom wall part 12B of the lower casing 12 so as to be rotatable and slidable. Also, the first outer circumferential surface 61 of the rotor 60 is fit into the rotation supporting surface 15 of the upper casing 11, thus the rotor 60 is rotatable about the casing axis Z, and the first cam member 66 and the second cam member 67 supported by the rotor 60 are disposed so as to be in contact with the cam surface 16 of the upper casing 11.

Furthermore, since the spherical middle portion 23 of the operation rod 20 is supported by the rod supporting part 63A of the rotor 60, the operation rod 20 can be tilted, pivoting on the spherical middle portion 23. Also, since the engaging rod parts 24 of the operation rod 20 respectively fit into the engagement groove parts 63B of the rotor 60, the operation rod 20 and the rotor 60 can rotate with each other in a unified manner.

Then, in a situation where the operation rod 20 is in the state of not being operated, the protruding member 42 of the orientation maintaining mechanism 40 is fit into the neutral depression part 43 due to the biasing force of the spring 41, and, as shown in FIG. 2 and FIG. 11, the operation rod 20 is maintained in the neutral orientation, in which the operation rod axis Q is perpendicular to the circuit substrate 30.

In this assembled state, the engagement part 22 at the inner end portion of the operation rod 20 engages with the contact surfaces 51A of the engagement hole part 51 of the slider 50, and the actuating pieces 22A are fit into the slider 50 so as not to be able to rotate relative to the slider 50. As a result, the slider 50 slides in conjunction with a tilting operation with the operation rod 20, and the slider 50 rotates in conjunction with a rotational operation with the operation rod 20.

[Operation Load on Rotational Operation with Knob]

In the multi-directional operation switch, the operation rod 20 is configured to be switchable to the retraction position H, the right position R, and to the left position L, and to the neutral position N according to a rotational operation with the knob 26 as described above. Also, the retraction position H and the neutral positon N have the positional relationship in which each is at a position of being mutually rotated 180 degrees about the casing axis Z. The right position R and the left position L are disposed at the positions rotated from the neutral positon N by 45 degrees (the positions that are separated by 90 degrees about the casing axis Z).

Figure 8:
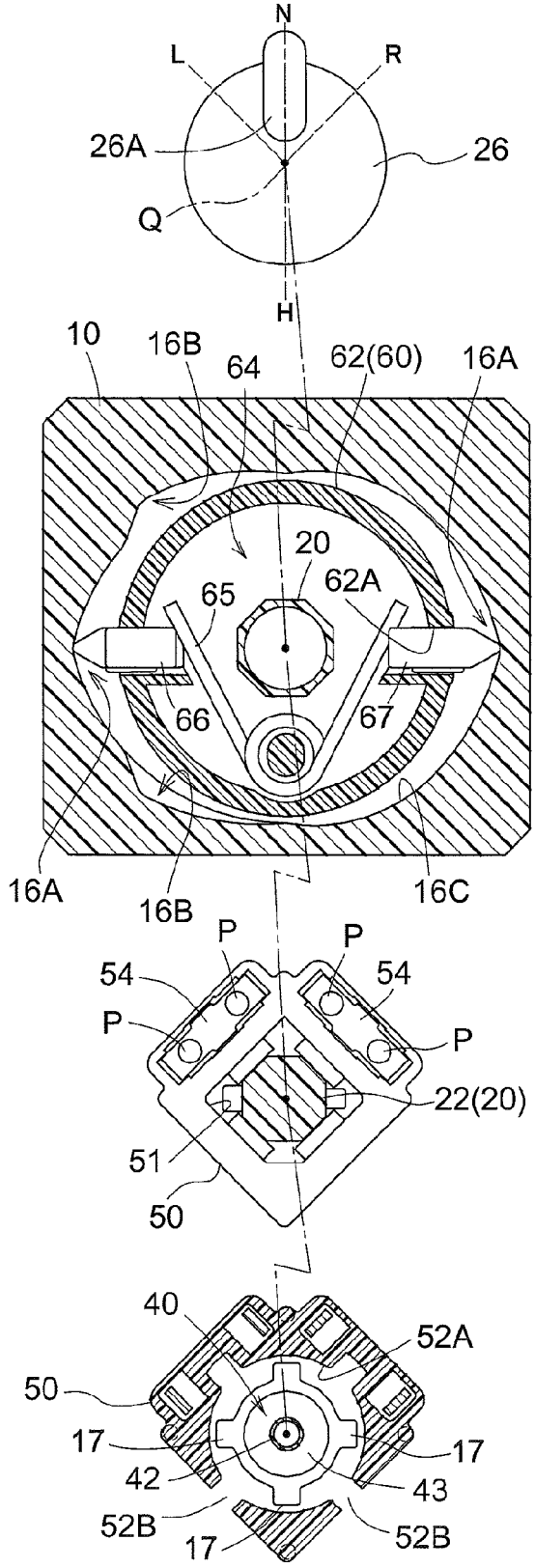
FIG. 8 is a diagram showing a relationship between the knob, the cam member, the slider, etc., in a neutral position.
Figure 10:
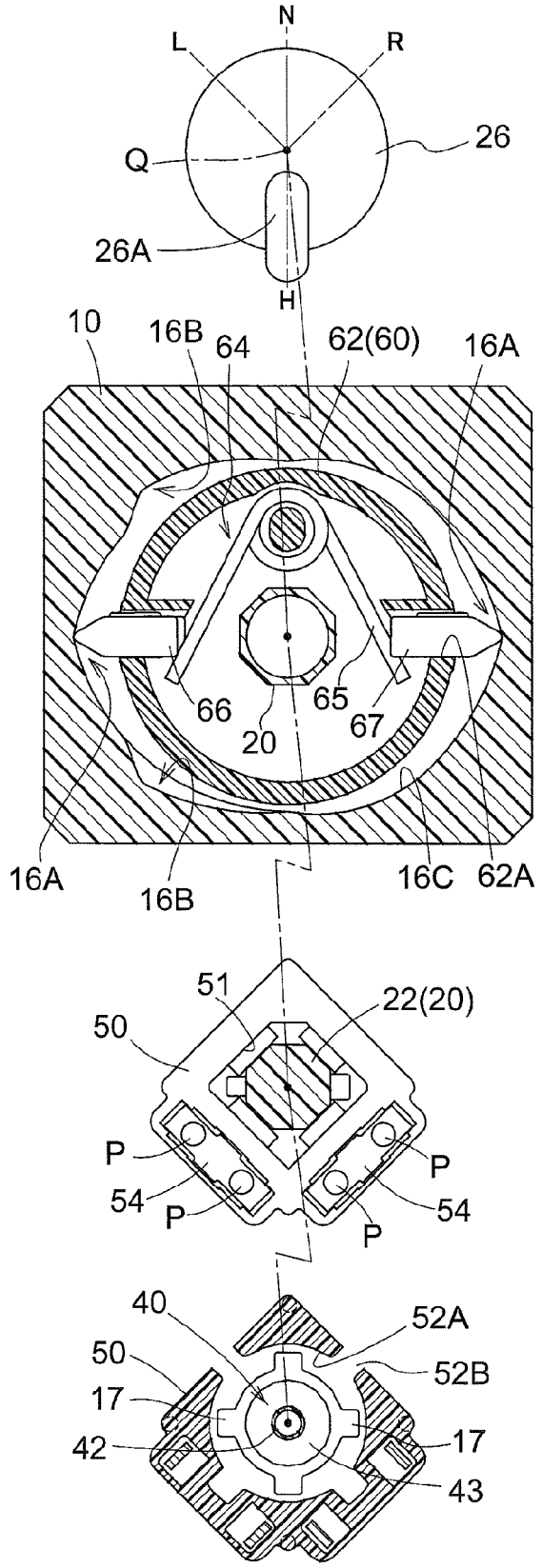
FIG. 10 is a diagram showing a relationship between the knob, the cam members, the slider, etc., in a retraction position.

With this structure, when the knob 26 is operated to the retraction position H or the neutral positon N, the first cam member 66 and the second cam member 67 are fit into their corresponding first depression areas 16A respectively as shown in FIG. 8 and FIG. 10, and the rotation position of the knob 26 is maintained by the biasing force of the torsion spring 65. In this way, in a situation where the first cam member 66 and the second cam member 67 are fit into their corresponding first depression areas 16A respectively, the first cam member 66 and the second cam member 67 have a positional relationship in which the first cam member 66 and the second cam member 67 are separated from each other, and accordingly the engaging force is weak and a rotational operation can be performed with light operation load.

Figure 7:
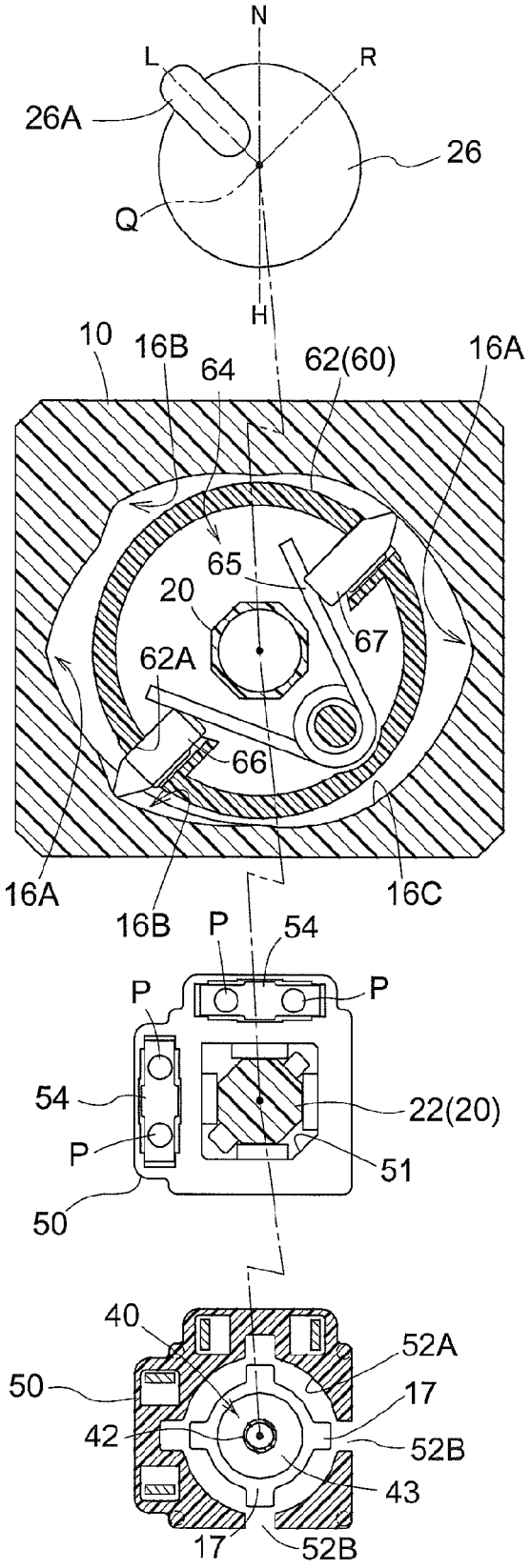
FIG. 7 is a diagram showing a relationship between a knob, cam members, a slider, etc., in a left position.
Figure 9:
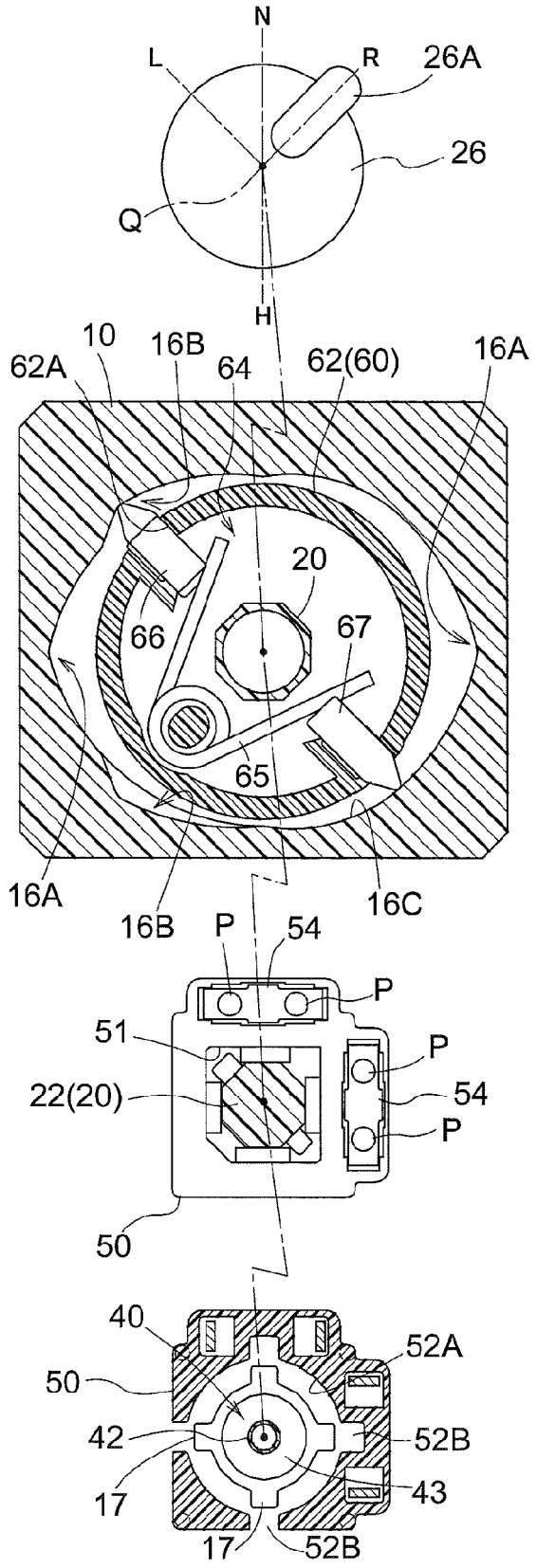
FIG. 9 is a diagram showing a relationship between the knob, the cam members, the slider, etc., in a right position.

Next, in a situation where the knob 26 is operated to the left position L or the right position R, the first cam member 66 is fit into the second depression areas 16B and the second cam member 67 is in contact with the guiding surface 16C as shown in FIG. 7 and FIG. 9, and the rotation position of the knob 26 is maintained by the biasing force of the torsion spring 65. In particular, in a situation where the first cam member 66 is fit into one of the second depression areas 16B and the second cam member 67 is in contact with the guiding surface 16C, the torsion spring 65 is compressed, and accordingly, a rotational operation is subjected to heavier operation load than in the case of operating the knob 26 in the retraction position H or in the neutral positon N, and the user can know the operational position based on the operating sensation.

[Modes of Detecting Operation]

FIG. 13 to FIG. 16 show the orientations of the slider 50 in situations where the knob 26 is operated to the left position L, the neutral positon N, the right position R, and the retraction position H, respectively. These drawings also show the relationship between the movable contacts 54 and the fixed contacts C.

[Mode of Detecting Operation: Left Position]

Figure 13:
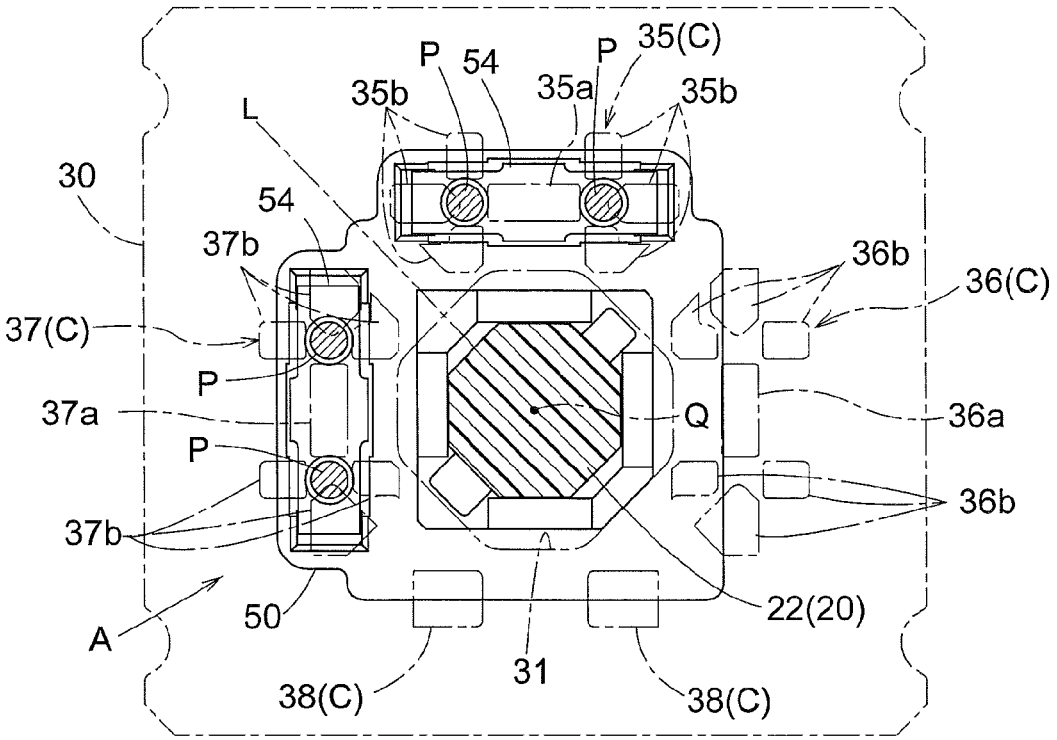
FIG. 13 is a diagram showing contact points, etc., when the knob is in the left position.

When the knob 26 is operated to the left position L, as shown in FIG. 13, the pair of contact points P of one of the movable contacts 54 are brought into contact with the pair of neutral detection contacts 35*b* between which the neutral reference contact 35*a* included in the group of neutral fixed contacts 35 is disposed. Simultaneously, the pair of contact points P of the other one of the movable contacts 54 are brought into contact with the pair of left detection contacts 37*b* between which the left reference contact 37*a* included in the group of left fixed contacts 37 is disposed.

Figure 17:
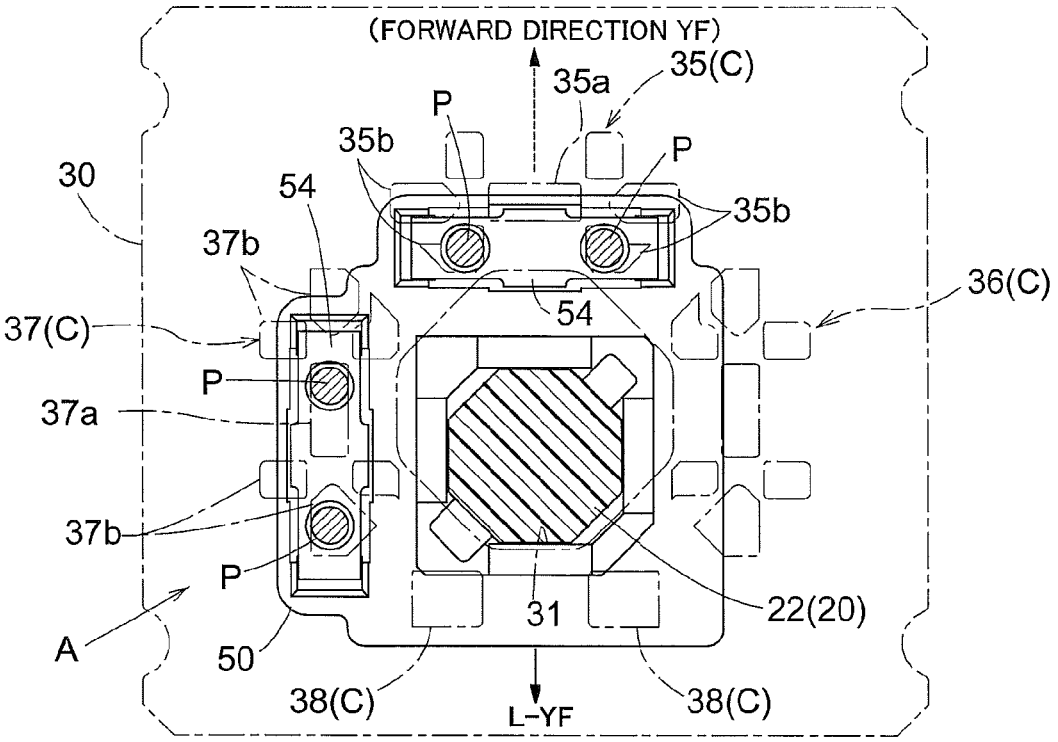
FIG. 17 is a diagram showing contact points, etc., at a forward tilting operation when the knob is in the left position.
Figure 18:
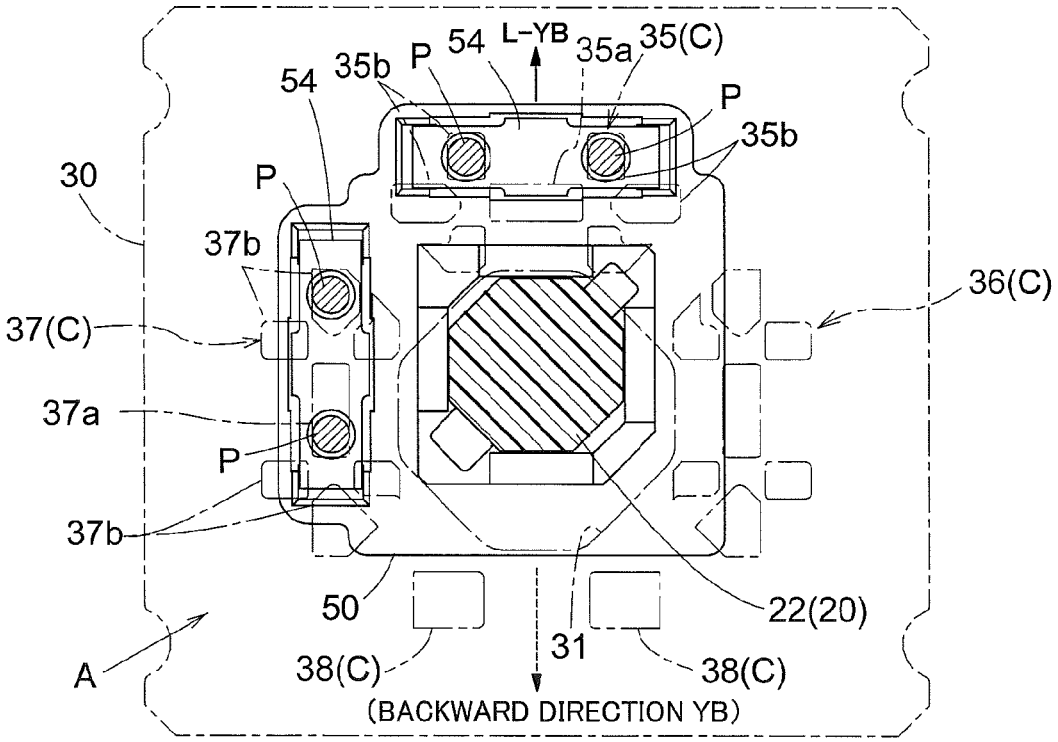
FIG. 18 is a diagram showing contact points, etc., at a backward tilting operation when the knob is in the left position.
Figure 19:
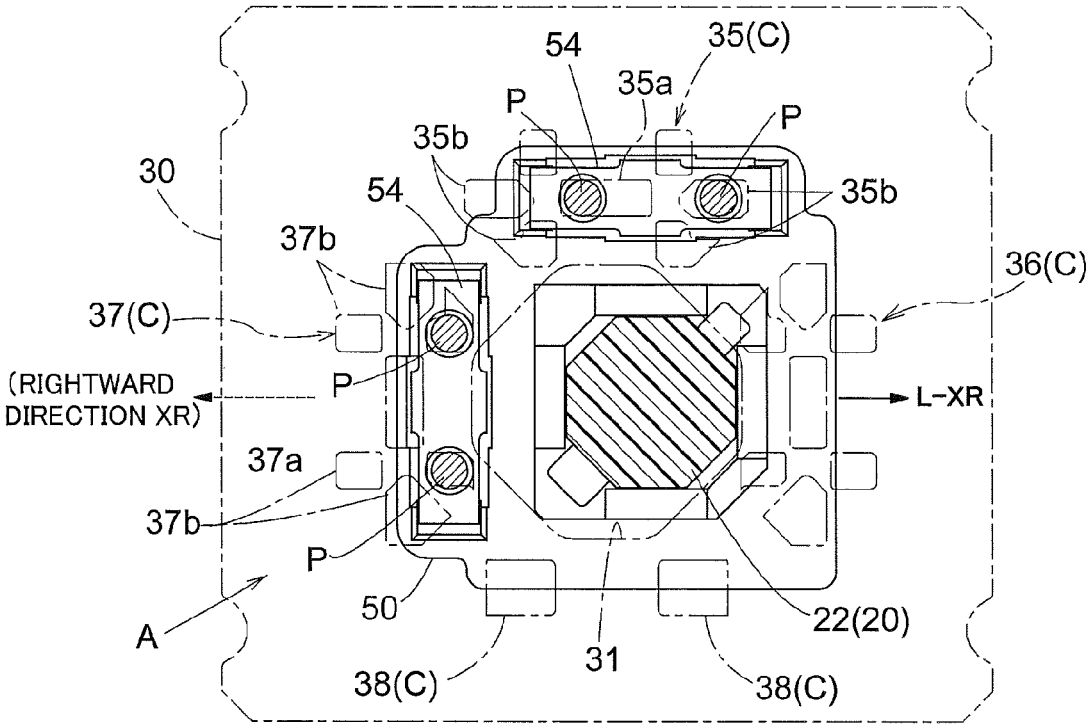
FIG. 19 is a diagram showing contact points, etc., at a rightward tilting operation when the knob is in the left position.
Figure 20:
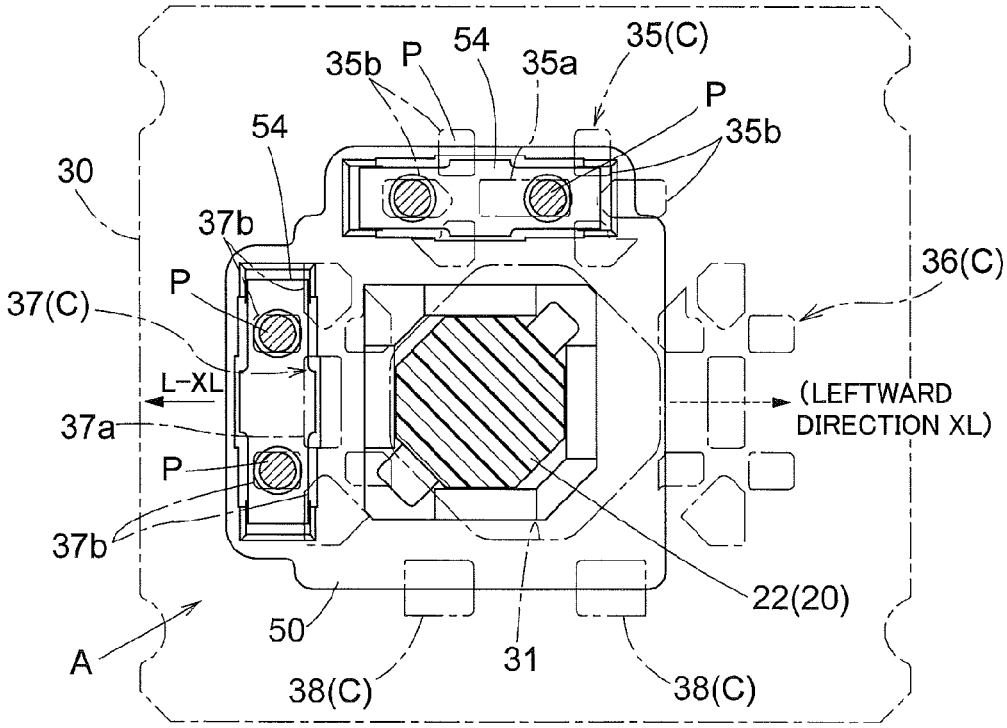
FIG. 20 is a diagram showing contact points, etc., at a leftward tilting operation when the knob is in the left position.

Also, in a situation where the knob 26 has been operated to the left position L, when the operation rod 20 is tilted by a human operation to the forward direction YF or the backward direction YB, the slider 50 moves to the opposite direction to the direction of the tilting operation as shown in FIG. 17 and FIG. 18. Similarly, when the operation rod 20 is tilted to the rightward direction XR or the leftward direction XL, the slider 50 moves to the opposite direction to the direction of the tilting operation, as shown in FIG. 19 and FIG. 20.

In other words, when the operation rod 20 is tilted to the forward direction YF, the slider 50 slides to the direction indicated by "L-YF" as shown in FIG. 17, and one pair of contact points P move in parallel ways with reference to the neutral reference contact 35*a* included in the group of neutral fixed contacts 35, and are brought into contact with, and are electrically connected to, the corresponding pair of neutral detection contacts 35*b*. Simultaneously, the other pair of contact points P move in parallel ways with reference to the left reference contact 37*a*, and are brought into contact with, and are electrically connected to, the left reference contact 37*a* and the corresponding left detection contacts 37*b*.

Similarly, when the operation rod 20 is tilted to the backward direction YB, the slider 50 moves to the direction indicated by "L-YB", as shown in FIG. 18. Also, when the operation rod 20 is tilted to the rightward direction XR, the slider 50 moves to the direction indicated by "L-XR", as shown in FIG. 19. Furthermore, when the operation rod 20 is tilted to the leftward direction XL, the slider 50 moves to the direction indicated by "L-XL", as shown in FIG. 20. With these operations, the pairs of contact points P move from the position of the reference contacts toward the detection contacts in parallel ways, and are brought into contact with, and are electrically connected to, the corresponding fixed contacts C.

These operations are detected by the control device, and by driving the vertical angle motor or the horizontal angle motor of the left-side power door mirror, the control device performs control to adjust the vertical angle or the horizontal angle of the mirror.

[Mode of Detecting Operation: Neutral Position]

Figure 14:
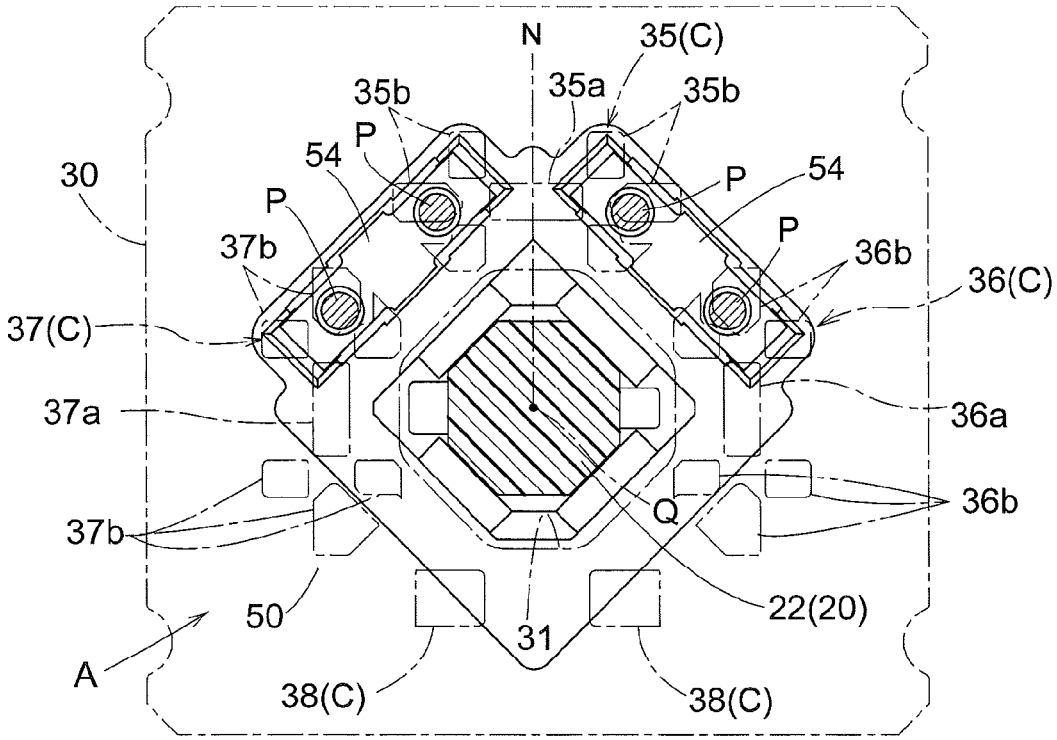
FIG. 14 is a diagram showing contact points, etc., when the knob is in the neutral position.

In a situation where the knob 26 is operated to the neutral positon N, as shown in FIG. 14, one of the pair of contact points P of one of the movable contacts 54 is brought into contact with one of the plurality of neutral detection contacts 35*b* included in the group of neutral fixed contacts 35, and the other one of the pair of contact points P is brought into contact with one of the plurality of left detection contacts 37*b* included in the group of left fixed contacts 37, and thus these contacts are electrically connected. Simultaneously, one of the pair of contact points P of the other one of the movable contacts 54 is brought into contact with one of the plurality of neutral detection contacts 35*b* included in the group of neutral fixed contacts 35, and the other one of the pair of contact points P is brought into contact with one of the plurality of right detection contacts 36*b* included in the group of right fixed contacts 36, and thus these contacts are electrically connected.

Note that although the state of electrical connection can be detected by the control device, no control is performed.

[Mode of Detecting Operation: Right Position]

Figure 15:
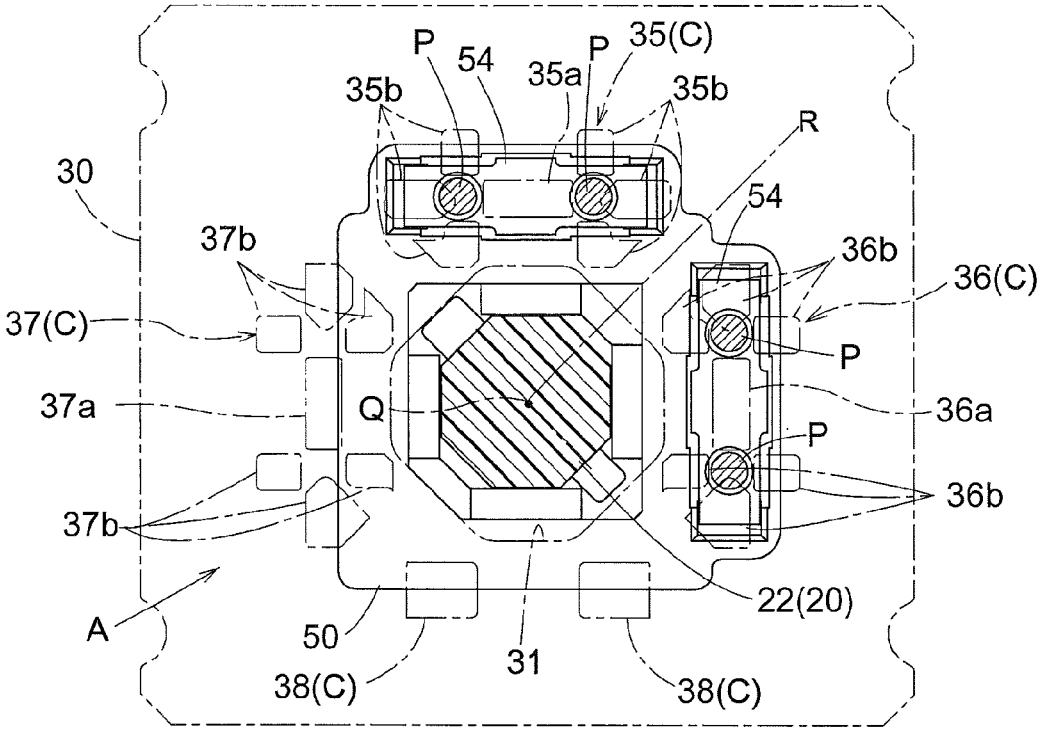
FIG. 15 is a diagram showing contact points, etc., when the knob is in the right position.

When the knob 26 is operated to the right position R, as shown in FIG. 15, the pair of contact points P of one of the movable contacts 54 are brought into contact with the pair of neutral detection contacts 35*b* between which the neutral reference contact 35*a* included in the group of neutral fixed contacts 35 is disposed. Simultaneously, the pair of contact points P of the other one of the movable contacts 54 are brought into contact with the pair of right detection contacts 36*b* between which the right reference contact 36*a* included in the group of right fixed contacts 36 is disposed.

Figure 21:
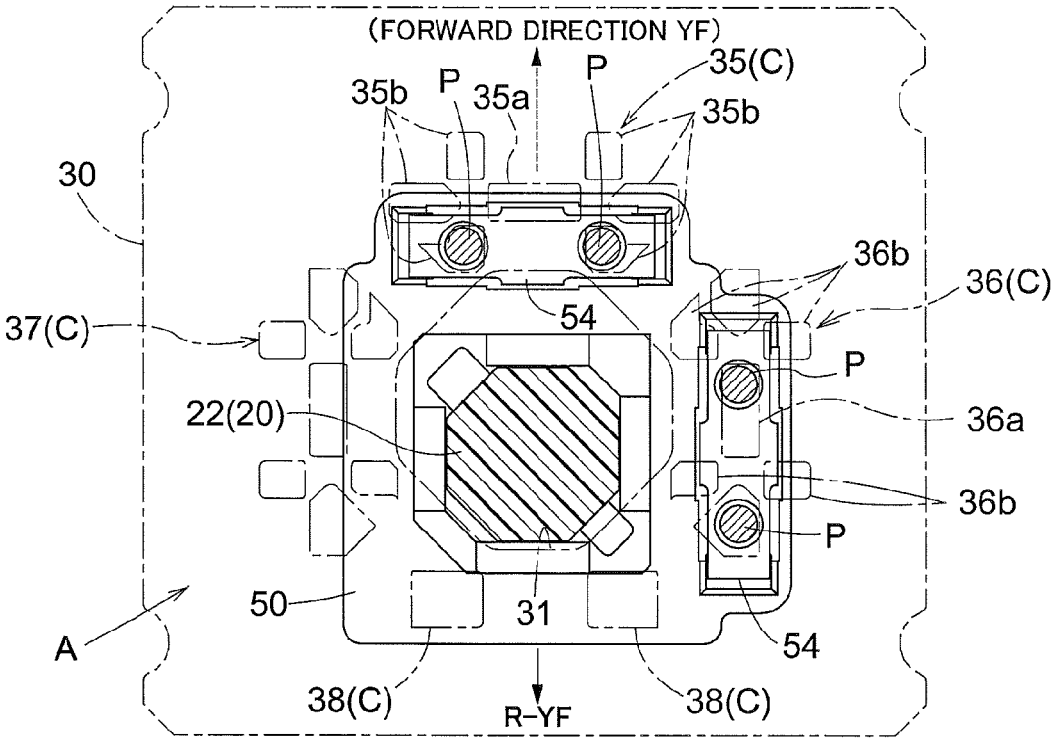
FIG. 21 is a diagram showing contact points, etc., at a forward tilting operation when the knob is in the right position.
Figure 22:
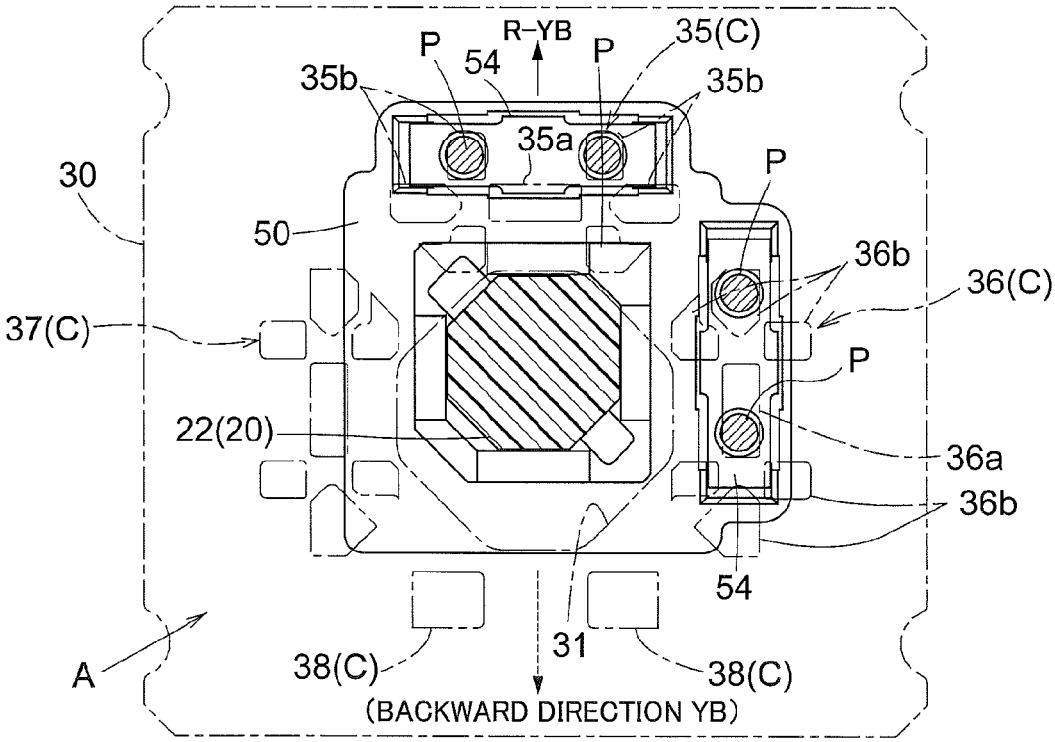
FIG. 22 is a diagram showing contact points, etc., at a backward tilting operation when the knob is in the right position.
Figure 23:
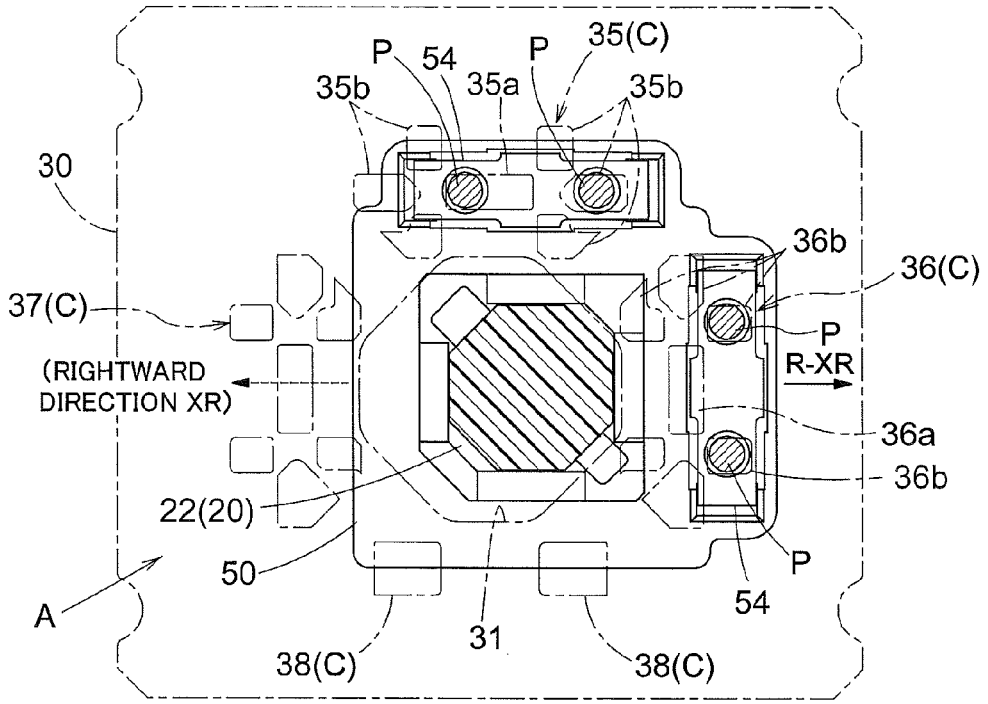
FIG. 23 is a diagram showing contact points, etc., at a rightward tilting operation when the knob is in the right position.
Figure 24:
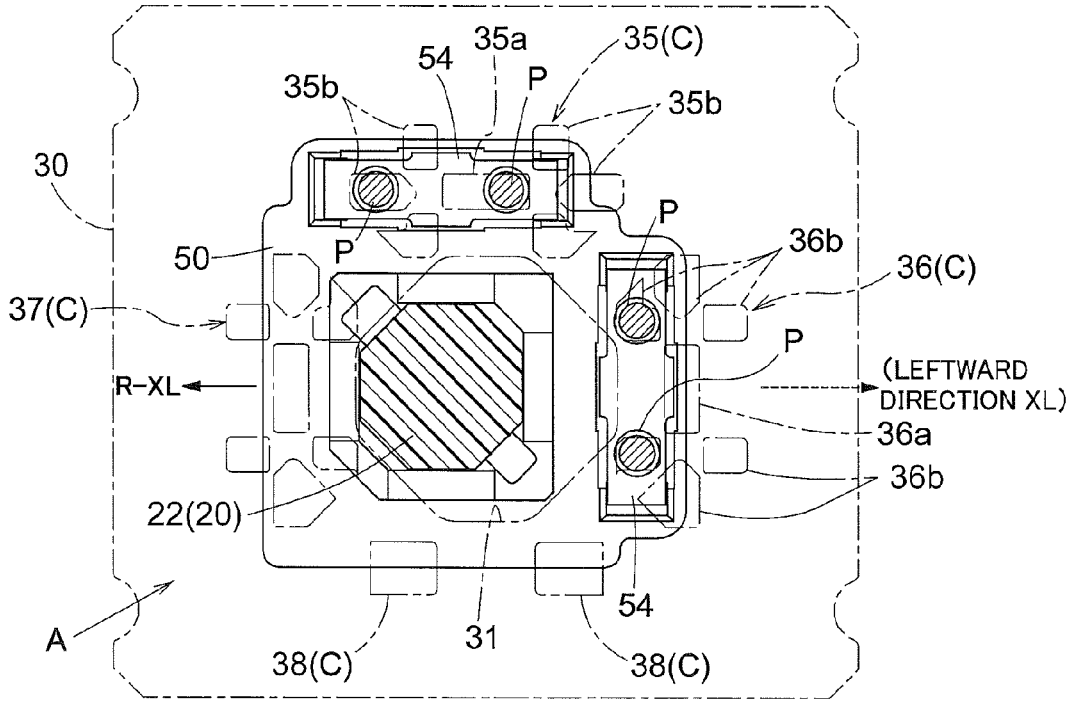
FIG. 24 is a diagram showing contact points, etc., at a leftward tilting operation when the knob is in the right position.

Also, in a situation where the knob 26 has been operated to the right position R, when the operation rod 20 is tilted by a human operation to the forward direction YF or the backward direction YB, the slider 50 moves to the opposite direction to the direction of the tilting operation as shown in FIG. 21 and FIG. 22. Similarly, when the operation rod 20 is tilted to the rightward direction XR or the leftward direction XL, the slider 50 moves to the opposite direction to the direction of the tilting operation, as shown in FIG. 23 and FIG. 24.

In other words, when the operation rod 20 is tilted to the forward direction YF, the slider 50 slides to the direction indicated by "R-YF" as shown in FIG. 21, and one pair of contact points P move in parallel ways with reference to the neutral reference contact 35*a* included in the group of neutral fixed contacts 35, and are brought into contact with, and are electrically connected to, one pair of neutral detection contacts 35*b*. Simultaneously, the other pair of contact points P move in parallel ways with reference to the right reference contact 36*a*, and are brought into contact with, and are electrically connected to, the right reference contact 36*a* and the corresponding right detection contacts 36*b*.

Similarly, when the operation rod 20 is tilted to the backward direction YB, the slider 50 moves to the direction indicated by "R-YB", as shown in FIG. 22. Also, when the operation rod 20 is tilted to the rightward direction XR, the slider 50 moves to the direction indicated by "R-XR", as shown in FIG. 23. Furthermore, when the operation rod 20 is tilted to the leftward direction XL, the slider 50 moves to the direction indicated by "R-XL", as shown in FIG. 24. With these operations, the pairs of contact points P move from the position of the reference contacts toward the detection contacts in parallel ways, and are brought into contact with, and are electrically connected to, the corresponding fixed contacts C.

These operations are detected by the control device, and by driving the vertical angle motor or the horizontal angle motor for the right-side power door mirror, the control device performs control to adjust the vertical angle or the horizontal angle of the mirror.

[Mode of Detecting Operation: Retraction Position]

Figure 16:
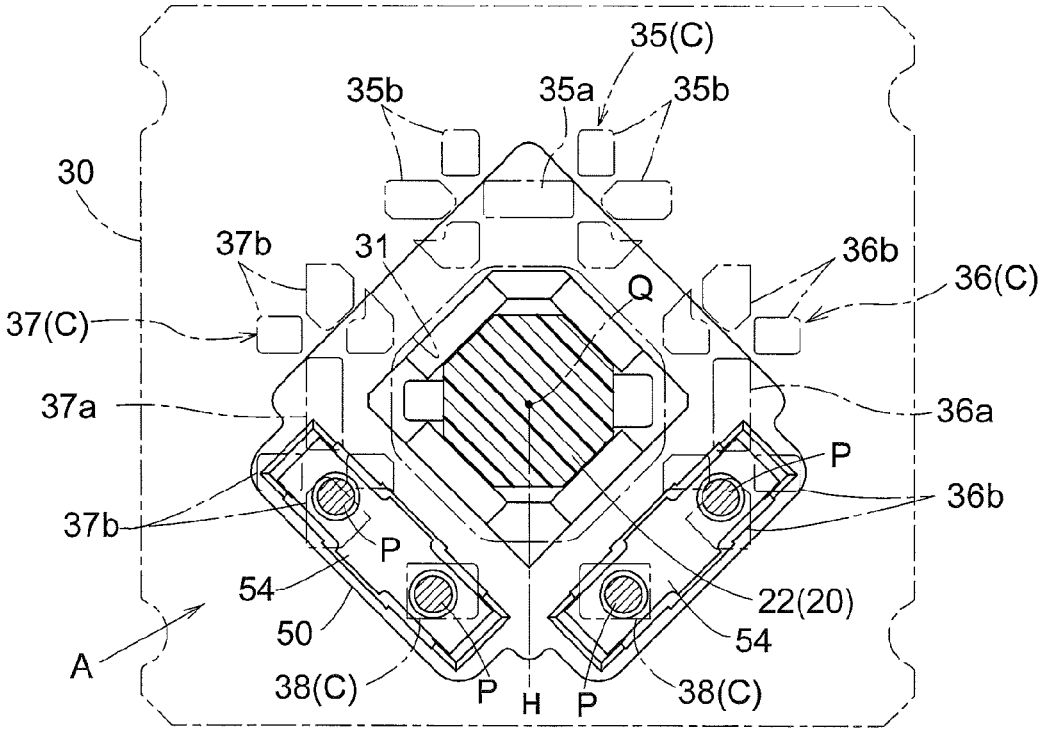
FIG. 16 is a diagram showing contact points, etc., when the knob is in the retraction position.

In a situation where the knob 26 is operated to the retraction position H, as shown in FIG. 16, one of the pair of contact points P of one of the movable contacts 54 is brought into contact with one of the retraction contacts 38, and the other one of the pair of contact points P is brought into contact with one of the plurality of left detection contacts 37*b* included in the group of left fixed contacts 37, and thus these contacts are electrically connected. Simultaneously, one of the pair of contact points P of the other one of the movable contacts 54 is brought into contact with one of the retraction contacts 38, and the other one of the pair of contact points P is brought into contact with one of the plurality of right detection contacts 36*b* included in the group of right fixed contacts 36, and thus these contacts are electrically connected.

In this way, the knob 26 in the retraction position H is detected by the control device, and by driving the retraction motor for the power door mirrors, the control device performs control to bring the power mirrors into their retracted positions. On the other hand, when the knob 26 is operated to be out of the retraction position H, a transition to the situation where none of the retraction contacts 38 are electrically connected to other fixed contacts C occurs, and based on this situation, by driving the retraction motor for the power door mirrors, the control device performs control to bring the power mirrors into their usage position (extended position).

[Advantageous Effects of Embodiment]

The multi-directional operation switch according to this disclosure has a configuration in which the slider 50 is disposed on the side of the back surface of the circuit substrate 30, the slider 50 is rotated in conjunction with a rotational operation with the operation rod 20, and the slider 50 is caused to slide in conjunction with a tilting operation with the operation rod 20. Also, the movement of the slider 50 is detected by the plurality of fixed contacts C formed on the back surface of the circuit substrate 30 and the pair of movable contacts 54 supported by the slider 50. Therefore, when compared with, for example, a switch that detects a rotational operation with the operation rod 20 on the front surface of the circuit substrate 30 and a tilting operation with the operation rod 20 on the back surface of the circuit substrate 30, the multi-directional operation switch according to this disclosure can have a simple configuration, and the number of parts can be reduced. Also, the switch as a whole can be miniaturized.

In this way, since the slider 50 is disposed on the side of the back surface of the circuit substrate 30, the number of parts disposed on the side of the front surface of the circuit substrate 30 can be reduced, and light rays emitted from the light emitting diodes 32 are unlikely to be blocked. According to this embodiment, the operation rod 20 and the rotor 60 are made from light-transmissive material, and accordingly it is possible to allow light rays to travel upward from the opening 11C of the upper casing 11 without being attenuated, and to illuminate the knob 26 (the indicator 26A). As a result, the user can exactly know the position of the knob 26 and the set position of the knob 26 even when it is too dark to see such as at night.

Note that it is possible to form only one of the operation rod 20 and the rotor 60 from light-transmissive resin. Even with this configuration, light rays from the light emitting diodes 32 can be guided to the knob 26, and the user can easily know the set position of the knob 26 even at night.

Also, regardless of whether the knob 26 is set to the retraction position H, the neutral positon N, the right position R, or the left position L, the first cam member 66 and the second cam member 67 fit into the first depression parts 16A or the second depression parts 16B, the set position of the knob 26 can be maintained, and a clicking feel can be provided. Also, since the operation load acting on the cam members (66, 67) is different for each setting position, the user can know the rotation position of the knob 26 based on the operating sensation.

The invention claimed is:

1. A multi-directional operation switch, comprising:

a circuit substrate having a hole formed therein;

a casing that houses the circuit substrate therein;

an operation rod having an outer end portion exposed to the outside of the casing, an inner end portion inserted in the hole in the circuit substrate, and a middle portion, and configured to be tiltable relative to the casing, with the middle portion serving as a pivot, and rotatable about an operation rod axis extending along a longitudinal direction of the operation rod;

an orientation maintaining mechanism that maintains an orientation of the operation rod to be a neutral orientation in which the operation rod is perpendicular to the circuit substrate;

a slider disposed on the side of a back surface of the circuit substrate, which is the opposite side to the outer end portion of the operation rod, and configured to rotate along the back surface of the circuit substrate in conjunction with a rotational operation with the operation rod, and to slide along the back surface in conjunction with a tilting operation with the operation rod; and an operation detector that detects a rotation position and a slide position of the slider, wherein the operation detector has a plurality of fixed contacts formed on the back surface of the circuit substrate, and at least one movable contact that is supported by the slider so as to be brought into contact with, and electrically connected to, the plurality of fixed contacts when the slider rotates or slides, wherein the operation rod is configured to allow a rotational operation about the operation rod axis only when the operation rod is in the neutral orientation, and the operation rod is configured to be able to be operated to a right position and a left position by being rotated by a rotational operation to a rightward direction and a leftward direction with reference to a neutral position, respectively, and to allow a tilting operation only when the operation rod is in the right position or the left position, and each of the plurality of fixed contacts includes:

a first fixed contact that overlaps the at least one movable contact of the slider when the operation rod is in the neutral orientation and has been switched to the right position or the left position; and a pair of second fixed contacts that are arranged separately from each other along a sliding direction of the slider, with the first fixed contact therebetween, such that the pair of second fixed contacts are brought into contact with, and are electrically connected to, the at least one movable contact when the slider slides along with a tilting operation with the operation rod, wherein the at least one movable contact has a pair of contact points electrically connected to each other, and when the operation rod is in the neutral position, one of the pair of contact points is brought into contact with one of the pair of second fixed contacts of one of two adjacent fixed contacts, and the other of the pair of contact points is brought into contact with one of the pair of second fixed contacts of the other of the two adjacent fixed contacts, to electrically connect said two adjacent fixed contacts and the at least one movable contact therebetween, and wherein each of the plurality of fixed contacts further includes at least one third fixed contact, the operation rod is configured to be able to be operated to a second neutral position by being rotated 180 degrees by a rotational operation with reference to the neutral position, and when the operation rod is in the second neutral position, one of the pair of contact points is brought into contact with one of the pair of second fixed contacts and the other of the pair of contact points is brought into contact with the third fixed contact to electrically connect the second and third fixed contacts and the movable contact therebetween.

2. The multi-directional operation switch according to claim 1, further comprising:

a rotor that is disposed within the casing, on a side of a front surface of the circuit substrate, and rotates with the operation rod in a unified manner;

a knob that is disposed outside the casing, on a side of the outer end portion of the operation rod, and includes light-transmissive material; and a light-emitter that is disposed on the side of the front surface of the circuit substrate and emits light when supplied with power, wherein at least one of the operation rod and the rotor includes light-transmissive material.

3. The multi-directional operation switch according to claim 1, further comprising:

a rotor that is disposed within the casing, on a side of a front surface of the circuit substrate, and rotates with the operation rod in a unified manner; and a cam member that protrudes outward from the rotor due to a biasing force applied in a direction that is perpendicular to the operation rod axis, wherein an inner surface of the casing has: a plurality of depression areas into which the cam member fits every time the operation rod reaches a predetermined rotation position due to a rotational operation with the operation rod, thereby maintaining the rotation position of the operation rod; and a guiding surface that changes an operation load of a rotational operation, acting within an area continuous with the plurality of depression areas.

4. The multi-directional operation switch according to claim 3, further comprising:

a knob that is disposed outside the casing, on a side of the outer end portion of the operation rod, and includes light-transmissive material; and a light-emitter that is disposed on the side of the front surface of the circuit substrate and emits light when supplied with power, wherein at least one of the operation rod and the rotor includes light-transmissive material.

5. The multi-directional operation switch according to claim 1, wherein the operation switch includes at least three fixed contacts and two movable contacts, and when the slider slides along with a tilting operation with the operation rod, in one of the two movable contacts, one of the pair of contact points is brought into contact with one of the pair of second fixed contacts and the first fixed contact of one of the fixed contacts to electrically connect said first and second fixed contacts and said one of the movable contacts therebetween, and in the other of the two movable contacts, the pair of contact points are brought into contact with the corresponding pair of second fixed contacts of another of the fixed contacts to electrically connect said second fixed contacts and said the other of the movable contacts therebetween.

6. The multi-directional operation switch according to claim 5, further comprising:

a rotor that is disposed within the casing, on a side of a front surface of the circuit substrate, and rotates with the operation rod in a unified manner;

a knob that is disposed outside the casing, on a side of the outer end portion of the operation rod, and includes light-transmissive material; and a light-emitter that is disposed on the side of the front surface of the circuit substrate and emits light when supplied with power, wherein at least one of the operation rod and the rotor includes light-transmissive material.

7. The multi-directional operation switch according to claim 5, further comprising:

a rotor that is disposed within the casing, on a side of a front surface of the circuit substrate, and rotates with the operation rod in a unified manner; and a cam member that protrudes outward from the rotor due to a biasing force applied in a direction that is perpendicular to the operation rod axis, wherein an inner surface of the casing has: a plurality of depression areas into which the cam member fits every time the operation rod reaches a predetermined rotation position due to a rotational operation with the operation rod, thereby maintaining the rotation position of the operation rod; and a guiding surface that changes an operation load of a rotational operation, acting within an area continuous with the plurality of depression areas.

8. The multi-directional operation switch according to claim 7, further comprising:

a knob that is disposed outside the casing, on a side of the outer end portion of the operation rod, and includes light-transmissive material; and a light-emitter that is disposed on the side of the front surface of the circuit substrate and emits light when supplied with power, wherein at least one of the operation rod and the rotor includes light-transmissive material.

9. A multi-directional operation switch, comprising:

a circuit substrate having a hole formed therein;

a casing that houses the circuit substrate therein;

an operation rod having an outer end portion exposed to the outside of the casing, an inner end portion inserted in the hole in the circuit substrate, and a middle portion, and configured to be tiltable relative to the casing, with the middle portion serving as a pivot, and rotatable about an operation rod axis extending along a longitudinal direction of the operation rod;

an orientation maintaining mechanism that maintains an orientation of the operation rod to be a neutral orientation in which the operation rod is perpendicular to the circuit substrate;

a slider disposed on the side of a back surface of the circuit substrate, which is the opposite side to the outer end portion of the operation rod, and configured to rotate along the back surface of the circuit substrate in conjunction with a rotational operation with the operation rod, and to slide along the back surface in conjunction with a tilting operation with the operation rod;

an operation detector that detects a rotation position and a slide position of the slider;

a rotor that is disposed within the casing, on a side of a front surface of the circuit substrate, and rotates with the operation rod in a unified manner; and a cam member that protrudes outward from the rotor due to a biasing force applied in a direction that is perpendicular to the operation rod axis, wherein the operation detector has a plurality of fixed contacts formed on the back surface of the circuit substrate, and at least one movable contact that is supported by the slider so as to be brought into contact with, and electrically connected to, the plurality of fixed contacts when the slider rotates or slides, wherein the operation rod is configured to allow a rotational operation about the operation rod axis only when the operation rod is in the neutral orientation, and the operation rod is configured to be able to be operated to a right position and a left position by being rotated by a rotational operation to a rightward direction and a leftward direction with reference to a neutral position, respectively, and to allow a tilting operation only when the operation rod is in the right position or the left position, and each of the plurality of fixed contacts includes:

a first fixed contact that overlaps the at least one movable contact of the slider when the operation rod is in the neutral orientation and has been switched to the right position or the left position; and a pair of second fixed contacts that are arranged separately from each other along a sliding direction of the slider, with the first fixed contact therebetween, such that the pair of second fixed contacts are brought into contact with, and are electrically connected to, the at least one movable contact when the slider slides along with a tilting operation with the operation rod, wherein the at least one movable contact has a pair of contact points electrically connected to each other, and when the operation rod is in the neutral position, one of the pair of contact points is brought into contact with one of the pair of second fixed contacts of one of two adjacent fixed contacts, and the other of the pair of contact points is brought into contact with one of the pair of second fixed contacts of the other of the two adjacent fixed contacts, to electrically connect said two adjacent fixed contacts and the at least one movable contact therebetween, and wherein an inner surface of the casing has: a plurality of depression areas into which the cam member fits every time the operation rod reaches a predetermined rotation position due to a rotational operation with the operation rod, thereby maintaining the rotation position of the operation rod; and a guiding surface that changes an operation load of a rotational operation, acting within an area continuous with the plurality of depression areas.

10. The multi-directional operation switch according to claim 9, further comprising:

a knob that is disposed outside the casing, on a side of the outer end portion of the operation rod, and includes light-transmissive material; and a light-emitter that is disposed on the side of the front surface of the circuit substrate and emits light when supplied with power, wherein at least one of the operation rod and the rotor includes light-transmissive material.

11. The multi-directional operation switch according to claim 9, wherein the operation switch includes at least three fixed contacts and two movable contacts, and when the slider slides along with a tilting operation with the operation rod, in one of the two movable contacts, one of the pair of contact points is brought into contact with one of the pair of second fixed contacts and the first fixed contact of one of the fixed contacts to electrically connect said first and second fixed contacts and said one of the movable contacts therebetween, and in the other of the two movable contacts, the pair of contact points are brought into contact with the corresponding pair of second fixed contacts of another of the fixed contacts to electrically connect said second fixed contacts and said the other of the movable contacts therebetween.

12. The multi-directional operation switch according to claim 11, further comprising:

a knob that is disposed outside the casing, on a side of the outer end portion of the operation rod, and includes light-transmissive material; and a light-emitter that is disposed on the side of the front surface of the circuit substrate and emits light when supplied with power, wherein at least one of the operation rod and the rotor includes light-transmissive material.

* * * * *